US007571099B2

(12) United States Patent
Saito et al.

(10) Patent No.: US 7,571,099 B2
(45) Date of Patent: Aug. 4, 2009

(54) VOICE SYNTHESIS DEVICE

(75) Inventors: Natsuki Saito, Osaka (JP); Takahiro Kamai, Kyoto (JP); Yumiko Kato, Osaka (JP)

(73) Assignee: Panasonic Corporation, Osaka (JP)

( * ) Notice: Subject to any disclaimer, the term of this patent is extended or adjusted under 35 U.S.C. 154(b) by 582 days.

(21) Appl. No.: 10/587,241

(22) PCT Filed: Jan. 17, 2005

(86) PCT No.: PCT/JP2005/000505

§ 371 (c)(1),
(2), (4) Date: Jul. 26, 2006

(87) PCT Pub. No.: WO2005/071664

PCT Pub. Date: Aug. 4, 2005

(65) Prior Publication Data

US 2007/0156408 A1 Jul. 5, 2007

(30) Foreign Application Priority Data

Jan. 27, 2004 (JP) ..... 2004-018715

(51) Int. Cl.
*G10L 13/06* (2006.01)

(52) U.S. Cl. ..... 704/268; 704/258; 704/260; 704/270; 704/257; 704/254

(58) Field of Classification Search ..... 704/268, 704/258, 254, 257, 260, 270
See application file for complete search history.

(56) References Cited

U.S. PATENT DOCUMENTS 4,912,768 A * 3/1990 Benbassat ..... 704/260

(Continued)

FOREIGN PATENT DOCUMENTS

JP 4-158397 6/1992

(Continued)

OTHER PUBLICATIONS

A. Sawabe et al., "Application of eigenvoice technique to spectrum and pitch pattern modeling in HMM-based speech synthesis," Technical Report of IEICE, Sep. 2001, The Instittue of Electronics, Information and Communication Engineers, pp. 65-72 (English Abstract).

*Primary Examiner*—Vijay B Chawan
(74) *Attorney, Agent, or Firm*—Wenderoth, Lind & Ponack, L.L.P.

(57) ABSTRACT

A voice synthesis device for generating synthetic voice having great freedom in voice quality and good sound quality from text data is provided.

The voice synthesis device is provided with: voice synthesis DBs (110*a* and 101*z*); a voice synthesis unit (103) for acquiring a text (10) and generating a voice synthesis parameter value sequence (11) of voice quality A which corresponds to a character that is included in the text (10) from the voice synthesis DB (101*a*); a voice synthesis unit (103) generating a voice synthesis parameter value sequence (11) of voice quality Z which corresponds to a character that is included in the text (10) from the voice synthesis DB (101*z*); a voice morphing unit (105) for generating a intermediate voice synthesis parameter value sequence (13) for indicating synthetic voice of intermediate voice quality between voice quality A and voice quality Z which corresponds to a character that is included in the text (10) from the voice synthesis parameter value sequence (11) of voice quality A and voice quality Z; and a speaker (107) for converting the generated intermediate voice synthesis parameter value sequence (13) to the synthetic voice and outputting the resulting synthetic voice.

9 Claims, 15 Drawing Sheets

U.S. PATENT DOCUMENTS

| | | | | |
|---|---|---|---|---|
| 5,878,396 | A * | 3/1999 | Henton | 704/276 |
| 6,101,470 | A * | 8/2000 | Eide et al. | 704/260 |
| 6,151,576 | A * | 11/2000 | Warnock et al. | 704/260 |
| 6,199,042 | B1 * | 3/2001 | Kurzweil | 704/260 |
| 6,249,758 | B1 * | 6/2001 | Mermelstein | 704/220 |
| 6,516,298 | B1 * | 2/2003 | Kamai et al. | 704/260 |
| 6,591,240 | B1 | 7/2003 | Abe | |
| 6,826,531 | B2 * | 11/2004 | Fukada | 704/258 |
| 7,039,588 | B2 * | 5/2006 | Okutani et al. | 704/258 |
| 7,249,021 | B2 * | 7/2007 | Morio et al. | 704/258 |
| 7,487,093 | B2 * | 2/2009 | Mutsuno et al. | 704/266 |
| 2005/0149330 | A1 * | 7/2005 | Katae | 704/267 |
| 2007/0156408 | A1 * | 7/2007 | Saito et al. | 704/260 |

FOREIGN PATENT DOCUMENTS

| | | |
|---|---|---|
| JP | 7-104791 | 4/1995 |
| JP | 7-319495 | 12/1995 |
| JP | 8-152900 | 6/1996 |
| JP | 9-050295 | 2/1997 |
| JP | 9-152892 | 6/1997 |
| JP | 9-244693 | 9/1997 |
| JP | 9-244694 | 9/1997 |
| JP | 2000-330582 | 11/2000 |
| JP | 2001-117597 | 4/2001 |
| JP | 2002-351489 | 12/2002 |

* cited by examiner

VOICE SYNTHESIS DEVICE

TECHNICAL FIELD

The present invention relates to a voice synthesis device for generating and outputting synthetic voice. Background Art Conventional voice synthesis devices for generating and outputting desired synthetic voice have been proposed (see for example Patent Reference 1, Patent Reference 2 and Patent Reference 3).

The voice synthesis device of Patent Reference 1 has a plurality of voice element databases having voice qualities that are different from each other, and generates and outputs desired synthetic voice by switching these voice element databases for use.

In addition, the voice synthesis device (voice modifying device) of Patent Reference 2 changes the spectrum of the results of voice analysis, and thereby generates and outputs desired synthetic voice.

In addition, the voice synthesis device of Patent Reference 3 carries out a morphing process on a plurality of pieces of waveform data, and thereby, generates and outputs desired synthetic voice.

Patent Reference 1: Japanese Laid-Open Patent Application No. 7-319495

Patent Reference 2: Japanese Laid-Open Patent Application No. 2000-330582

Patent Reference 3: Japanese Laid-Open Patent Application No. 9-50295

DISCLOSURE OF INVENTION

Problems that Invention is to Solve

However, the above described voice synthesis devices of Patent Reference 1, Patent Reference 2 and Patent Reference 3 have a problem, such that there is little freedom of voice quality conversion, and it is very difficult to adjust sound quality.

That is to say, in Patent Reference 1, the voice quality of synthetic voice is limited to the preset voice quality, and continuous change in this preset voice quality cannot be expressed.

In addition, in Patent Reference 2, in the case where the dynamic range in the spectrum is increased, sound quality deteriorates, making it difficult to maintain good sound quality.

Furthermore, in Patent Reference 3, portions of a plurality of pieces of waveform data (for example peaks in the waveforms) which correspond to each other are specified, and a morphing process is carried out with these portions as a reference, and these portions may be specified by mistake. As a result, the sound quality of the generated synthetic voice becomes poor. Thus, the present invention is provided in view of these problems, and an object thereof is to provide a voice synthesis device for generating synthetic voice having great freedom in voice quality and good sound quality from text data.

Means to Solve the Problems

In order to achieve the above described object, the voice synthesis device according to the present invention includes: a memory unit that stores, in advance for each voice quality, voice element information regarding a plurality of voice elements having a the plural voice qualities that are different from each other; a voice information generating unit that acquires text data, and generates, from plural pieces of the voice element information stored in the memory unit, synthetic voice information for each of the voice qualities, the synthetic voice information indicating synthetic voice having the voice quality which corresponds to a character that is included in the text data; a designating unit that places fixed points at $N^{th}$ dimensional coordinates for display where N is a natural number, the fixed points indicating voice quality of each piece of the voice element information stored in the memory unit, and places plural set points at the coordinates for display on the basis of operation by a user so as to derive and designate a ratio at which changes each of plural pieces of the synthetic voice information which contributes to morphing along a time sequence on the basis of the placement of a moving point and the fixed points, the moving point continuously moving between the plural set points along the time sequence; a morphing unit that generates, intermediate synthetic voice information using each of the plural pieces of synthetic voice information generated by the voice information generating unit with the ratio of change along the time sequence designated by the designating unit, the intermediate synthetic voice information indicating synthetic voice having intermediate voice quality, between the plural voice qualities, which corresponds to a character that is included in the text data; and a voice outputting unit that converts, to synthetic voice having the intermediate voice quality, the intermediate synthetic voice information generated by the morphing unit, and outputs the resulting synthetic voice, wherein the voice information generating unit generates each of the plural pieces of synthetic voice information as a sequence of each of plural characteristic parameters, and the morphing unit generates the intermediate synthetic voice information by calculating an intermediate value of the plural characteristic parameters to which the plural pieces of synthetic voice information respectively correspond.

As a result, synthetic voice having intermediate voice quality between the first and second voice qualities is outputted only when the first voice element information on the first voice quality and the second voice element information on the second voice quality, for example, are stored, in advance, in a memory unit, and therefore, the freedom in the voice quality can be made greater without limiting the voice quality to the content that is stored, in advance, in the memory unit. In addition, intermediate synthetic voice information is generated on the basis of the first and second synthetic voice information having the first and second voice qualities, and therefore, no processing for making the dynamic range of the spectrum excessively large is carried out, unlike in the prior art, and thus, the voice quality of the synthetic voice can be maintained in a good state. In addition, the voice synthesis device according to the present invention acquires text data and outputs synthetic voice in accordance with a character sequence that is included in the text data, and therefore, ease of use can be increased for the user. Furthermore, the voice synthesis device according to the present invention calculates the intermediate value between the characteristic parameters which respectively correspond to the first and second synthetic voice information so as to generate intermediate synthetic voice information, and therefore, does not make any mistake when specifying the portion for reference, and can improve the sound quality of the synthetic voice and reduce the amount of calculation, as compared to a case where a morphing process is carried out on two spectra as in the prior art. Furthermore, in the voice synthesis device according to the present invention, the ratio of contribution of a plurality of pieces of synthetic voice information to morphing changes in accordance with the fixed points and the set points which are placed on the basis of operation by the user, and therefore, the user can easily input the degree of similarity to the voice quality of voice element information.

In addition, a voice synthesis device according to the present invention includes: a memory unit that stores, in advance, first voice element information regarding plural voice elements having a first voice quality, and second voice element information regarding plural voice elements having a second voice quality that is different from the first voice quality; a voice information generating unit that acquires text data, generates, from the first voice element information in the memory unit, first synthetic voice information indicating synthetic voice having the first voice quality which corresponds to a character that is included in the text data, and generates, from the second voice element information in the memory unit, second synthetic voice information indicating synthetic voice having the second voice quality which corresponds to a character that is included in the text data; a morphing unit that generates, from the first and second synthetic voice information generated by the voice information generating unit, intermediate synthetic voice information indicating synthetic voice having intermediate voice quality between the first and second voice quality which each corresponds to a character that is included in the text data; and a voice outputting unit that converts, to synthetic voice having the intermediate voice quality, the intermediate synthetic voice information generated by the morphing unit, and outputs the resulting synthetic voice, wherein the voice information generating unit generates each of the first and second synthetic voice information as a sequence of plural characteristic parameters, and the morphing unit generates the intermediate synthetic voice information by calculating an intermediate value of characteristic parameters to which the first and second synthetic voice information respectively correspond.

As a result, synthetic voice having intermediate voice quality between the first and second voice qualities is outputted only when the first voice element information on the first voice quality and the second voice element information on the second voice quality are stored in a memory unit in advance, and therefore, the freedom in the voice quality can be made greater without limiting the voice quality to the content that is stored in the memory unit in advance.

In addition, intermediate synthetic voice information is generated on the basis of the first and second synthetic voice information having the first and second voice qualities, and therefore, no processing for making the dynamic range of the spectrum excessively large is carried out, unlike in the prior art, and thus, the voice quality of the synthetic voice can be maintained in a good state.

In addition, the voice synthesis device according to the present invention acquires text data and outputs synthetic voice in accordance with a character sequence that is included in the text data, and therefore, ease of use can be increased for the user. Furthermore, the voice synthesis device according to the present invention calculates the intermediate value between the characteristic parameters which respectively correspond to the first and second synthetic voice information so as to generate intermediate synthetic voice information, and therefore, do not make any mistake when specifying the portion for reference, and can improve the sound quality of the synthetic voice and reduce the amount of calculation, as compared to a case where a morphing process is carried out on two spectra as in the prior art.

Here, the above described morphing unit may be characterized by changing the ratio of contribution of the above described first and second synthetic voice information to the above described intermediate synthetic voice information so that the voice quality of the synthetic voice outputted form the above described voice outputting unit continuously changes during the output of the synthetic voice.

As a result, the voice quality of synthetic voice continuously changes while this synthetic voice is being outputted, and therefore, synthetic voice which continuously changes from normal voice to angry voice, for example, can be outputted.

In addition, the above described memory unit may be characterized by storing characteristic information which indicates the standard in each voice element that is indicated by each of the above described first and second voice element information in such a manner that the characteristic information is included in each of the above described first and second voice element information, the above described voice information generating unit may be characterized by generating the above described first and second synthetic voice information in such a manner that the above described characteristic information is included in each of the above described first and second synthetic voice information, and the above described morphing unit may be characterized by matching the above described first and second synthetic voice information using the standard that is indicated by the above described characteristic information which is included in each of the above described first and second synthetic voice information, and after that, generates the above described intermediate synthetic voice information. For example, the above described standard is a point at which the acoustic characteristic of each voice element that is indicated by each of the above described first and second voice element information changes. In addition, the above described point at which the acoustic characteristic change is a point at which the state transits along the most likely course where each voice element that is indicated by each of the above described first and second voice element information is represented by HMM (hidden Markov model), and the above described morphing unit matches the above described first and second synthetic voice information along the time axis using the above described point at which the state transits, and after that, generates the above described intermediate synthetic voice information.

As a result, the first and second synthetic voice information is matched using the above described reference for the generation of intermediate synthetic voice information by means of the morphing unit, and therefore, intermediate synthetic voice information can be generated by achieving matching quickly in comparison with a case where, for example, the first and second synthetic voice information is matched through pattern matching or the like, and as a result, the processing rate can be increased. In addition, the point at which the state transits along the most likely path indicated by HMM (hidden Markov model) is used as the reference, and thereby, the first and second synthetic voice information can be precisely matched along the time axis.

In addition, the above described voice synthesis device may be characterized by being further provided with: an image storing unit that stores first image information indicating an image which corresponds to the above described first voice quality and second image information indicating an image which corresponds to the above described second voice quality in advance; an image morphing unit that generates intermediate image information indicating an intermediate image of images which are respectively indicated by the above described first and second image information, that is, an image which corresponds to the voice quality of the above described intermediate synthetic sound information from the above described first and second image information; and a display unit that acquires intermediate image information that is generated by the above described image morphing unit and display an image that is indicated by the above described intermediate image information in sync with synthetic voice outputted from the above described voice outputting unit. For example, the above described first image information indicates a face image which corresponds to the above described first voice quality, and the above described second image information indicates a face image which corresponds to the above described second voice quality.

As a result, a face image which corresponds to an intermediate voice quality between the first and second voice qualities is displayed in sync with the output of the synthetic voice having intermediate voice quality between these, and therefore, the voice quality of the synthetic voice can be conveyed to the user together with the expressions of the face image, and thus, increase in the expressiveness can be achieved.

Here, the above described voice information generating unit may be characterized by sequentially and respectively generating first and second synthetic voice information as described above.

As a result, the processing load of the voice information generating unit per time unit can be reduced, and the configuration of the voice information generating unit can be simplified. As a result, the device as a whole can be miniaturized, and at the same time, reduction in cost can be achieved.

In addition, the above described voice information generating unit may be characterized by respectively generating first and second synthetic voice information as described above in parallel.

As a result, the first and second synthetic voice information can be generated quickly, and as a result, the period of time from the acquirement of text data to the output of synthetic speed can be shortened.

Here, the present invention can be implemented as a method or a program for generating and outputting synthetic voice from the above described voice synthesis device, or as a recording medium for storing such a program.

EFFECTS OF THE INVENTION

The voice synthesis device of the present invention has effects such that synthetic voice having great freedom in voice quality and good sound quality can be generated from text data.

NUMERICAL REFERENCES

Figure 1:
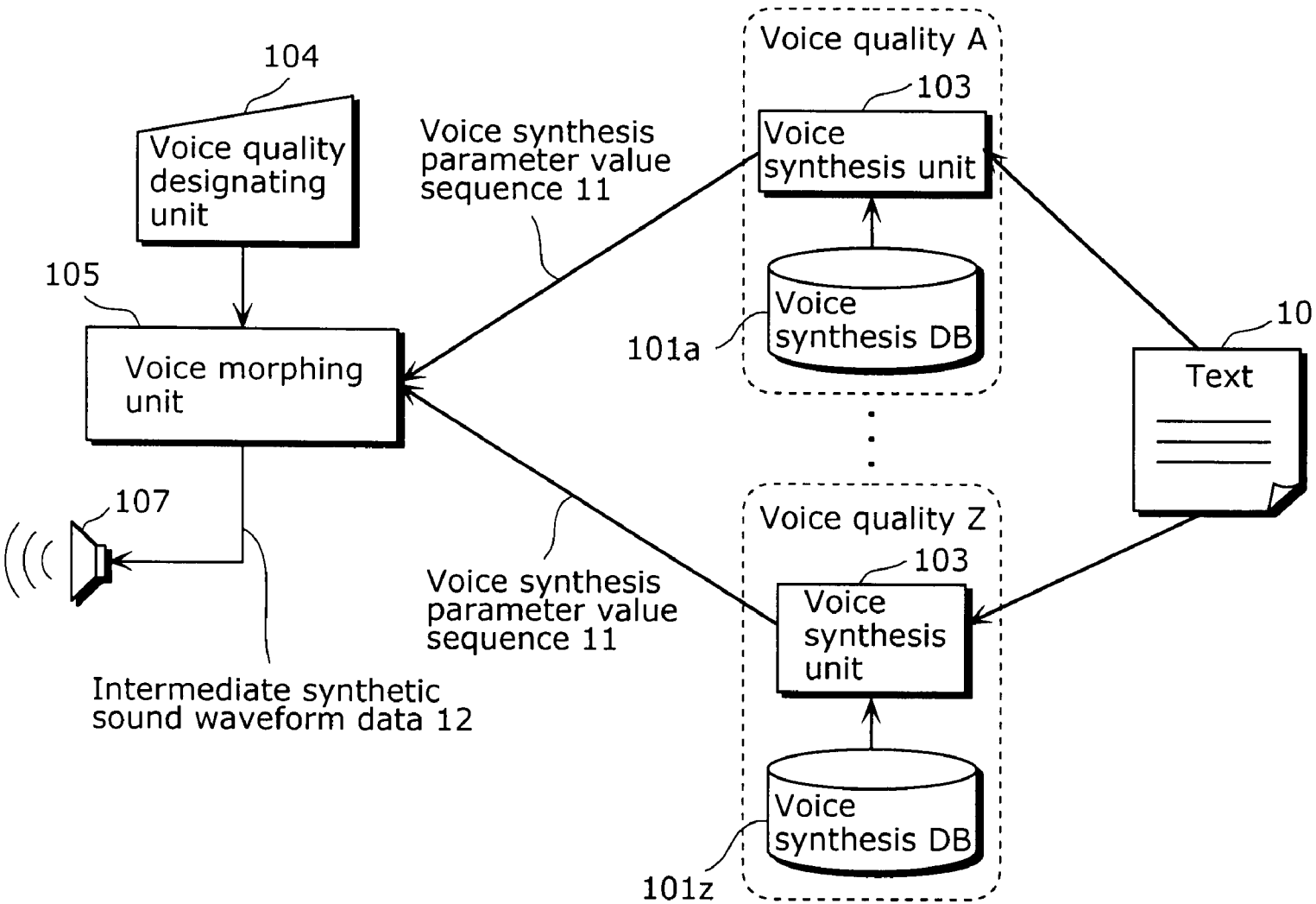
FIG. 1 is a configuration diagram showing the configuration of a voice synthesis device according to the first embodiment of the present invention.

10 text
10*a* Phoneme information
11 Voice synthesis parameter value sequence
12 Intermediate synthetic sound waveform data
12*p* Intermediate face image data
13 Intermediate voice synthesis parameter value sequence
30 Voice element
31 Phoneme model
32 Form of most likely path
41 Synthetic sound spectrum
50 Formant form
50*a*, 50*b* Frequency
51 Window for analyzing Fourier spectrum
61 Synthetic sound waveform data
101*a* to 101*z* Voice synthesis DB
103 Voice synthesis unit
103*a* Language processing unit
103*b* Element connecting unit
104 Voice quality designating unit
104A, 104B, 104Z Voice quality icon
104*i* Designated icon
105 Voice morphing unit
105*a* Parameter intermediate value calculating unit
105*b* Waveform generating unit
106 Intermediate synthetic sound waveform data
107 Speaker
203 Voice synthesis unit
201*a* to 201*z* Voice synthesis DB
205 Voice morphing unit
205*a* Spectrum morphing unit
205*b* Waveform generating unit

303 Voice synthesis unit
301*a* to 301*z* Voice synthesis DB
305 Voice morphing unit
305*a* Waveform editing unit
401*a* to 401*z* Image DB
405 Image morphing unit
407 Display unit
P1 to P3 Face image

BEST MODE FOR CARRYING OUT THE INVENTION

In the following, the embodiments of the present invention are described in detail in reference to the drawings.

FIRST EMBODIMENT

FIG. 1 is a configuration diagram showing the configuration of a voice synthesis device according to the first embodiment of the present invention.

The voice synthesis device of the present embodiment generates synthetic voice having great freedom in voice quality and good sound quality from text data, and is provided with: a plurality of voice synthesis DBs 101*a* to 101*z* for storing voice element data on a plurality of voice elements (phonemes); a plurality of voice synthesis units (voice information generating unit) 103 for generating a voice synthesis parameter value sequence 11 which corresponds to the character sequence shown in text 10 using voice element data that is stored in one voice synthesis DB; a voice quality designating unit 104 for designating voice quality on the basis of operation by a user; a voice morphing unit 105 for carrying out a voice morphing process using voice synthesis parameter value sequence 11 that has been generated by the plurality of voice synthesis units 103 and outputting intermediate synthetic sound waveform data 12; and a speaker 107 for outputting synthetic voice on the basis of intermediate synthetic sound waveform data 12.

Voice qualities indicated by the voice element data that is stored by respective voice synthesis DBs 101*a* to 101*z* are different from one another. Voice synthesis DB 101*a* stores, for example, voice element data of laughing voice quality, and voice synthesis DB 101*z* stores voice element data of angry voice quality. In addition, the voice element data according to the present embodiment is expressed in the form of a sequence of characteristic parameter values of a voice generating model. Furthermore, label information indicating the time of starting and ending of each voice element that is indicated by each piece of the stored voice element data, as well as the point in time at which the acoustic characteristic changes, is added to these pieces of data.

The plurality of voice synthesis units 103 are made to correspond to each of the above described voice synthesis DBs one-to-one. The operation of such a voice synthesis unit 103 is described in reference to FIG. 2.

Figure 2:
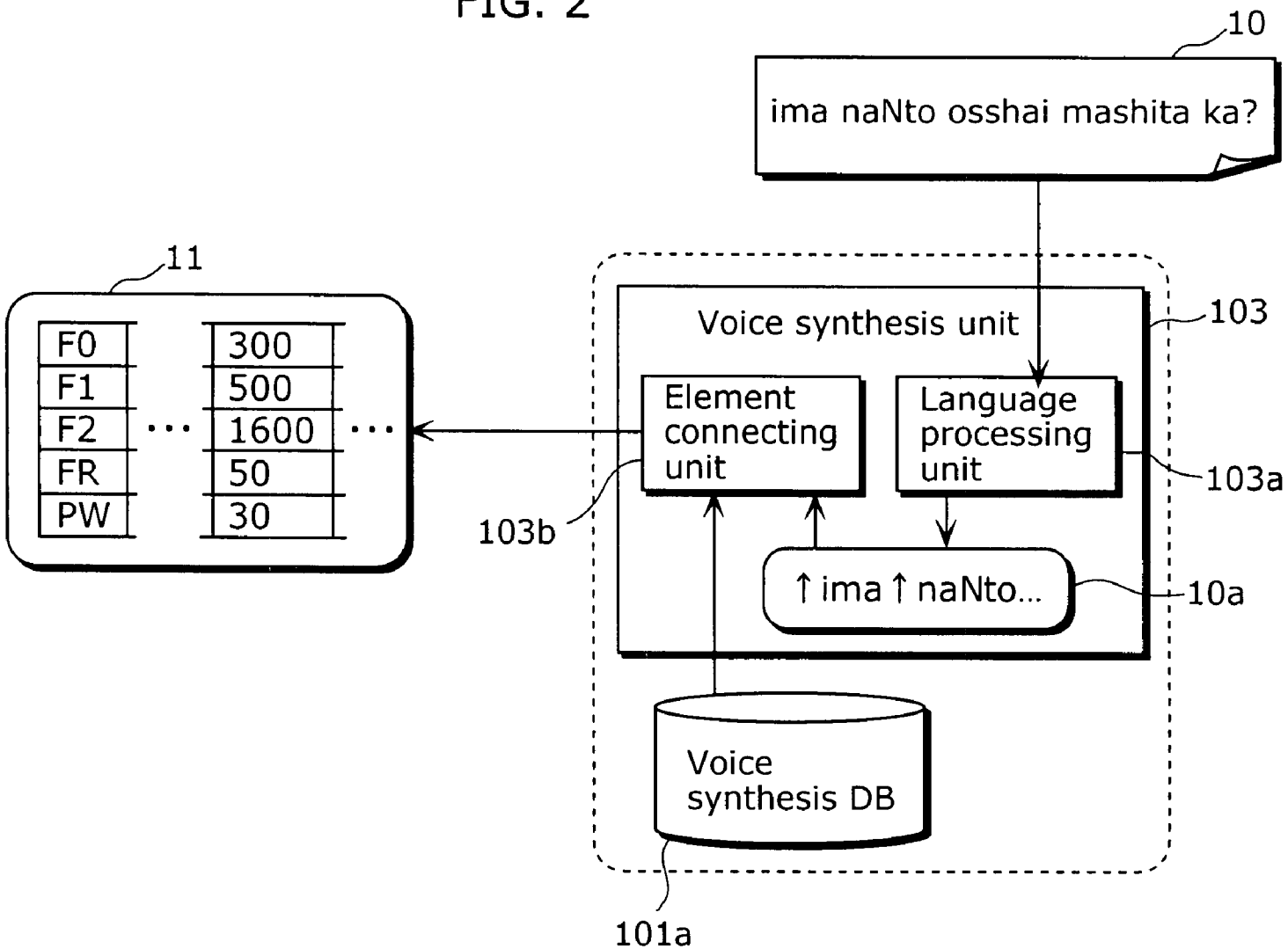
FIG. 2 is an illustrative diagram for illustrating the operation of the voice synthesis unit of the voice synthesis device.

FIG. 2 is an illustrative diagram for illustrating the operation of a voice synthesis unit 103.

As shown in FIG. 2, a voice synthesis unit 103 is provided with a language processing unit 103*a* and an element connecting unit 103*b*.

Language processing unit 103*a* acquires text 10 and converts a character sequence shown in text 10 shows phoneme information 10*a*. Phoneme information 10*a* is gained by representing a character sequence indicated in text 10 in the form of a phoneme sequence, and may additionally include information required for element selection, connection and modification, such as accent position information and information on the length of continuation of phonemes.

Element connecting unit 103*b* extracts a portion on an appropriate voice element from the voice element data of a corresponding voice synthesis DB, and connects and modifies the portion that has been extracted, and thereby, generates a voice synthesis parameter value sequence 11 which corresponds to phoneme information 10*a* that is outputted by language processing unit 103*a*. Voice synthesis parameter value sequence 11 is gained by aligning a plurality of characteristic parameter values which include enough of the information that is required for generating an actual voice waveform. Voice synthesis parameter value sequence 11, for example, is formed so as to include five characteristic parameters for each voice analyzing synthesis frame along the time sequence, as shown in FIG. 2. The five characteristic parameters are basic frequency of voice F0, first formant F1, second formant F2, length of continuation of voice analyzing synthesis frame FR and sound source intensity PW. In addition, label information is attached to voice element data as described above, and therefore, label information is also attached to voice synthesis parameter value sequence 11 that is generated in this manner.

Voice quality designating unit 104 designates, on the basis of operation by the user, which voice synthesis parameter value sequence 11 is used, and with what ratio the voice morphing process is carried out on this voice synthesis parameter value sequence 11, for voice morphing unit 105. Furthermore, voice quality designating unit 104 changes this ratio along the time sequence. This voice quality designating unit 104 is made up of, for example, a personal computer, and is provided with a display which shows the results of operation by the user.

Figure 3:
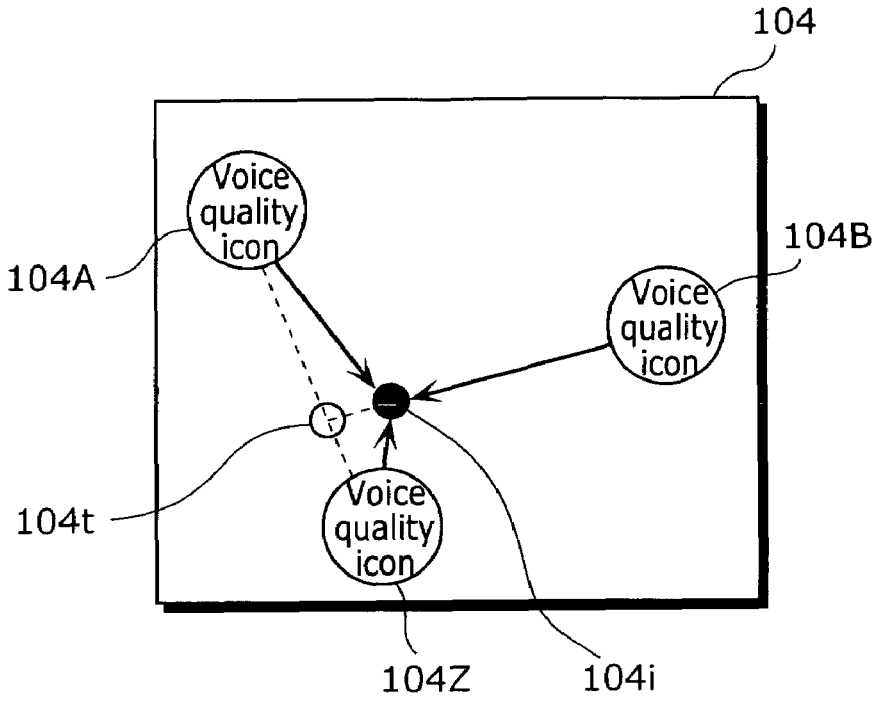
FIG. 3 is an image display diagram showing an example of an image displayed by the display of the voice quality designating unit of the voice synthesis device.

FIG. 3 is an image display diagram showing an example of an image on the display of voice quality designating unit 104.

On the display, a plurality of voice quality icons for indicating the voice quality of voice synthesis DBs 101*a* to 101*z* are displayed. Here, FIG. 3 shows voice quality icon 104A of voice quality A, voice quality icon 104B of voice quality B, and voice quality icon 104Z of voice quality Z from among a plurality of voice quality icons. These plurality of voice quality icons are arranged in such a manner that the more similar the voice quality shown by each icon is, the closer icons are to each other, and the less similar the voice quality shown by each icon is, the farther away icons are from each other.

Here, voice quality designating unit 104 displays a designation icon 104*i* which can be moved through operation by the user on the above described display.

Voice quality designating unit 104 checks voice quality icons which are close to designation icons 104*i* which are arranged by the user and specifies, for example, voice quality icons 104*a*, 104*b* and 104*z*, and then indicates that voice synthesis parameter value sequence 11 of voice quality A, voice synthesis parameter value sequence 11 of voice quality B and voice synthesis parameter value sequence 11 of voice quality Z are used for voice morphing unit 105. Furthermore, voice quality designating unit 104 designates the ratio of each of voice quality icons 104A, 104B, 104Z and designation icon 104*i* which corresponds to the relative position for voice morphing unit 105.

That is to say, voice quality designating unit 104 checks the distance between designation icon 104*i* and each of voice quality icons 104A, 104B and 104Z, and designates the ratio which corresponds to these distances.

In addition, voice quality designating unit 104 first finds the ratio for generating intermediate voice quality (temporary voice quality) between voice quality A and voice quality Z, and next, finds the ratio for generating voice quality that is indicated by designation icon 104*i* from this temporary voice quality and voice quality B, and then, designates these ratios. Concretely, voice quality designating unit 104 calculates the line which connects voice quality icon 104A and voice quality icon 104Z, as well as the line which connects voice quality icon 104B and designation icon 104*i*, and specifies the position 104*t* of the intersection of these lines. The voice quality that is indicated by this position 104*t* is the above described temporary voice quality. Then, voice quality designating unit 104 finds the ratio of the distance between position 104*t* and voice quality icon 104A to that between position 104*t* and voice quality icon 104Z. Next, voice quality designating unit 104 finds the ratio of the distance between designation icon 104*i* and voice quality icon 104B to that between designation icon 104*i* and position 104*t*, and designates the two ratios that have been found in this manner.

The user can easily input the degree of similarity between the voice quality of the synthetic voice that is to be outputted from speaker 107 and the preset voice quality by operating the above described voice quality designating unit 104. Therefore, the user operates voice quality designating unit 104 so that designation icon 104*i* approaches voice quality icon 104A when synthetic voice that is close to, for example, voice quality A, is desired to be outputted from speaker 107.

In addition, voice quality designating unit 104 continuously changes the above described ratio along the time sequence in response to operation by the user.

Figure 4:
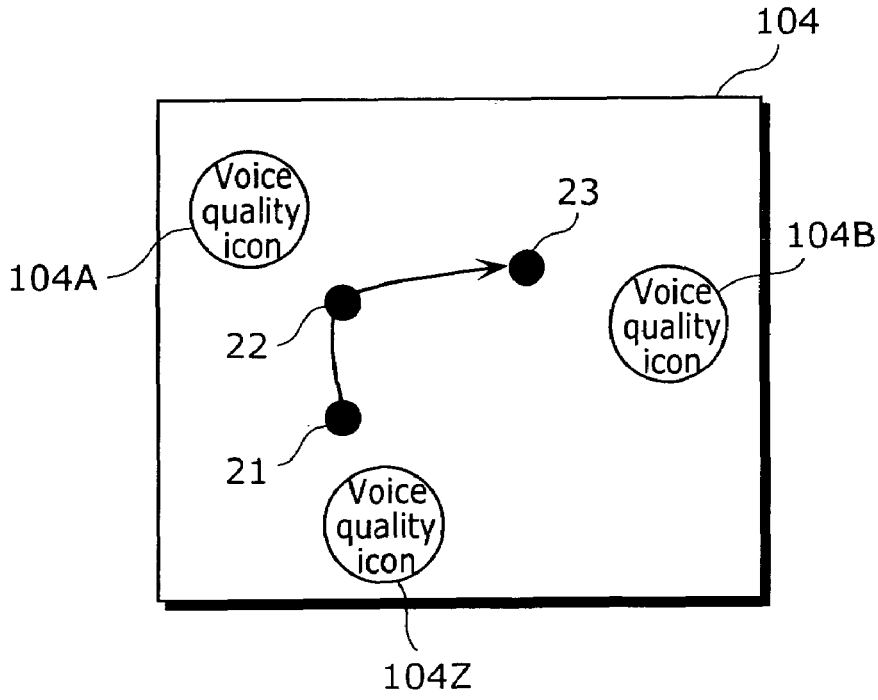
FIG. 4 is an image display diagram showing another example of an image displayed by the display of the voice quality designating unit of the voice synthesis device.

FIG. 4 is an image display diagram showing another example of an image on the display of voice quality designating unit 104.

Voice quality designating unit 104 arranges three icons 21, 22 and 23 on the display in response to operation by the user, as shown in FIG. 4, and specifies the track which passes from icon 21 through icon 22 so as to reach icon 23. Then, voice designating unit 104 continuously changes the above described ratio along the time sequence so that designation icon 104*i* moves along this track. When the length of this track is L, for example, voice quality designating unit 104 changes this ratio so that designation icon 104*i* moves at a rate of 0.01×L per second.

Voice morphing path 105 carries out a voice morphing process using voice synthesis parameter value sequence 11 that has been designated by the above described voice quality designating unit 104, as well as the ratio.

Figure 5:
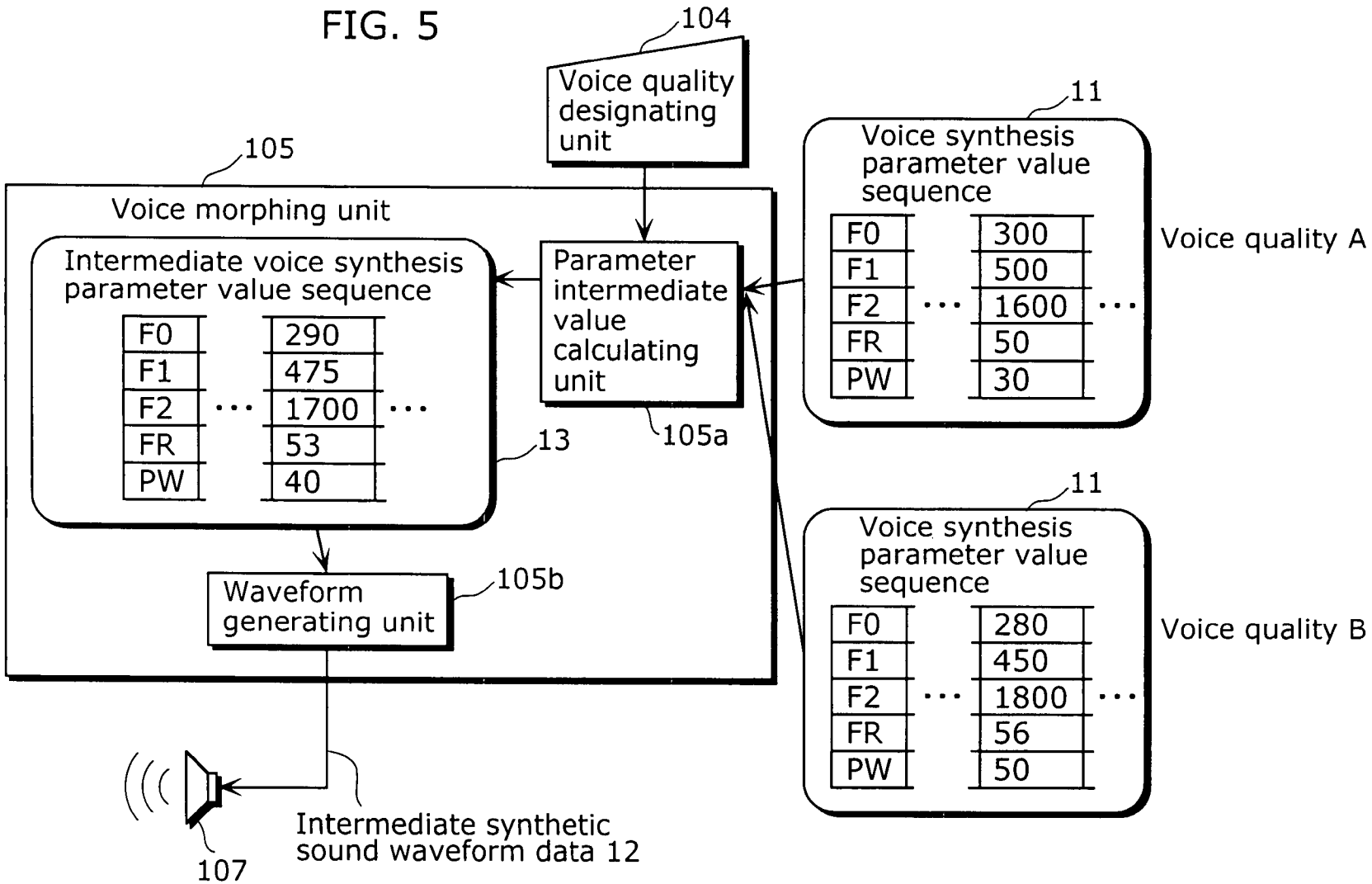
FIG. 5 is an illustrative diagram for illustrating a process operation of the voice morphing unit of the voice synthesis device.

FIG. 5 is an illustrative diagram for illustrating a processing operation for voice morphing unit 105.

Voice morphing unit 105 is provided with a parameter intermediate value calculating unit 105*a* and a waveform generating unit 105*b*, as shown in FIG. 5.

Parameter intermediate value calculating unit 105*a* specifies at least two sequences of voice synthesis parameter values 11 that have been designated by voice quality designating unit 104, as well as the ratio, and generates a intermediate voice synthesis parameter value sequence 13 in accordance with this ratio from these sequences of voice synthesis parameter values 11 for each of the voice analyzing synthesis frames that correspond to each other.

When, for example, parameter intermediate value calculating unit 105*a* specifies a voice synthesis parameter value sequence 11 of voice quality A, a voice synthesis parameter value sequence 11 of voice quality Z and ratio 50:50 on the basis of designation by voice quality designating unit 104, first, voice synthesis parameter value sequence 11 of voice quality A and voice synthesis parameter value sequence 11 of voice quality Z are acquired from voice synthesis unit 103 which corresponds to each sequence. Then, parameter intermediate value calculating unit 105*a* calculates the intermediate value between each characteristic parameter that is included in voice synthesis parameter value sequence 11 of voice quality A and each characteristic parameter that is included in voice synthesis parameter value sequence 11 of voice quality Z with a ratio of 50:50 in voice analyzing synthesis frames which correspond to each other, and generates these calculation results as a intermediate voice synthesis parameter value sequence 13. Concretely, in the case where the value of basic frequency F0 of voice synthesis parameter value sequence 11 of voice quality A is 300 and the value of basic frequency F0 of voice synthesis parameter value sequence 11 of voice quality Z is 280 in voice analyzing synthesis frames which correspond to each other, parameter intermediate value calculating unit 105*a* generates intermediate voice synthesis parameter value sequence 13 where basic frequency F0 is 290 in this voice analyzing synthesis frame.

In addition, as described in reference to FIG. 3, in the case where voice quality designating unit 104 designates voice synthesis parameter value sequence 11 of voice quality A, voice synthesis parameter value sequence 11 of voice quality B and voice synthesis parameter value sequence 11 of voice quality Z, and furthermore, the ratio for generating intermediate temporary voice quality between voice quality A and voice quality B (for example 3:7) and the ratio for generating voice quality that is indicated by designation icon 104*i* from the temporary voice quality and voice quality B (for example 9:1), voice morphing unit 105 first carries out a voice morphing process with a ratio of 3:7 using voice synthesis parameter value sequence 11 of voice quality A and voice synthesis parameter value sequence 11 of voice quality Z. As a result, a voice synthesis parameter value sequence corresponding to the temporary voice quality is generated. Furthermore, voice morphing unit 105 uses the voice synthesis parameter value sequence that has been generated in advance and voice synthesis parameter value sequence 11 of voice quality B so as to carry out a voice morphing process with a ratio of 9:1. As a result, intermediate voice synthesis parameter value sequence 13 corresponding to designation item 104*i* is generated. Here, the above described voice morphing process with a ratio of 3:7 is a process for making voice synthesis parameter value sequence 11 of voice quality A closer to voice synthesis parameter value sequence 11 of voice quality Z by 3/(3+7), and conversely, a process for making voice synthesis parameter value sequence 11 of voice quality Z closer to voice synthesis parameter value sequence 11 of voice quality A by 7/(3+7). As a result, the generated voice synthesis parameter value sequence become more similar to voice synthesis parameter value sequence 11 of voice quality A than voice synthesis parameter value sequence 11 of voice quality Z.

Waveform generating unit 105*b* acquires intermediate voice synthesis parameter value sequence 13 that has been generated by parameter intermediate value calculating unit 105*a*, and generates intermediate synthetic sound waveform data 12 in accordance with this intermediate voice synthesis parameter value sequence 13 so as to output the resulting data to speaker 107.

As a result, synthetic voice in accordance with intermediate voice synthesis parameter value sequence 13 is outputted from speaker 107. That is to say, synthetic voice having intermediate voice quality between a plurality of preset voice qualities is outputted from speaker 107.

Here, the total number of voice analyzing synthesis frames which are included in a plurality of sequences of voice synthesis parameter values 11 is generally different from case to case, and therefore, when parameter intermediate value calculating unit 105*a* carries out a voice morphing process using voice synthesis parameter value sequence 11 having different voice qualities as described above, it aligns the time axis in order to make voice analyzing synthesis frames correspond to each other.

That is to say, parameter intermediate value calculating unit 105*a* matches sequences of voice synthesis parameter values 11 along the time axis on the basis of label information attached to these sequences of voice synthesis parameter values 11.

Label information indicates the time of starting and ending of each voice element as described above, and the time of the point at which the acoustic characteristic changes. The point at which the acoustic characteristic changes is, for example, the point at which the state of the most likely path that is indicated by the phoneme model of unspecified speaker HMM corresponding to a voice element transits.

Figure 6:
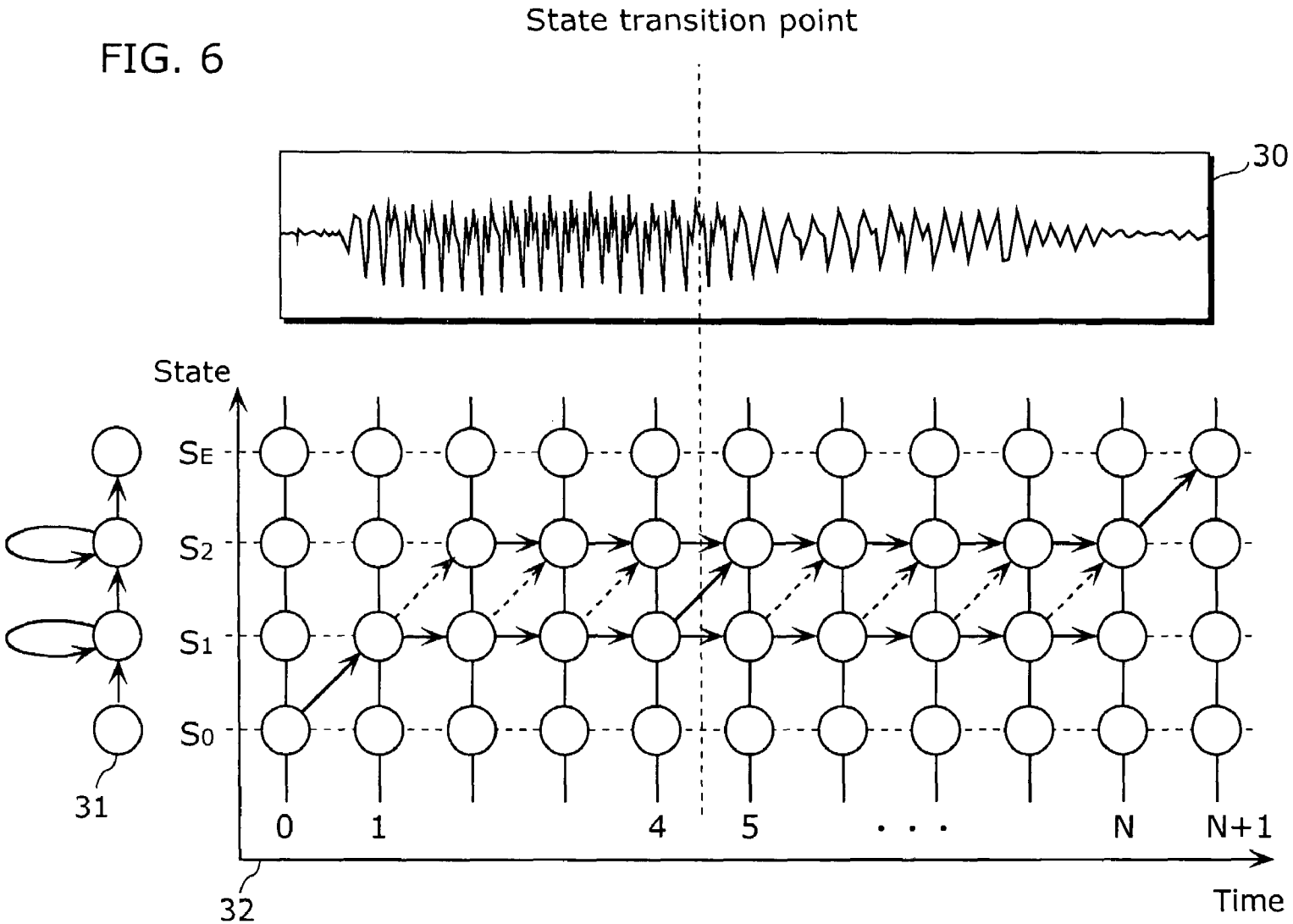
FIG. 6 is an illustrative diagram showing an example of voice elements of the voice synthesis device and an HMM phoneme model.

FIG. 6 is an illustrative diagram showing an example of a voice element and an HMM phoneme model.

As shown in FIG. 6, for example, in the case where a predetermined voice element 30 is recognized in an unspecified speaker HMM phoneme model (hereinafter abbreviated to phoneme model) 31, this phoneme model 31 is made up of four states ($S_0$, $S_1$, $S_2$ and $S_E$), including the starting state ($S_0$) and the ending state ($S_E$). Here, the form 32 of the most likely path undergoes state transition from state S1 to state S2 from time 4 and 5. That is to say, label information indicating starting time 1, ending time N and time 5 of the point at which the acoustic characteristic changes for voice element 30 is attached to the portion of voice element data that is stored in voice synthesis DBs 101*a* to 101*z* which corresponds to this voice element 30.

Accordingly, parameter intermediate value calculating unit 105*a* carries out a time axis expanding or shrinking process on the basis of starting time 1, ending time N and time 5 of the point at which the acoustic characteristic changes, which are indicated by this label information. That is, parameter intermediate value calculating unit 105*a* expands and shrinks the time intervals of each of the acquired sequences of voice synthesis parameter values 11 in a linear manner, so that the time that is indicated by the label information is in agreement.

As a result, parameter intermediate value calculating unit 105*a* can make each of the voice analyzing synthesis frames correspond to each voice synthesis parameter value sequence 11. That is to say, the time axis can be aligned. In addition, in this manner, the time axis is aligned using label information according to 10 the present embodiment, and thereby, the time axis can be aligned quickly in comparison with a case where, for example, the time axis is aligned through pattern matching of the respective sequences of voice synthesis parameter values 11.

As described above, according to the present embodiment, parameter intermediate value calculating unit 105*a* carries out a voice morphing process in accordance with the ratio that is designated by voice quality designating unit 104 on a plurality of sequences of voice synthesis parameter values 11 designated by voice quality designating unit 104, and therefore, the freedom in the voice quality of synthetic voice can be increased.

In the case where, for example, the user operates voice quality designating unit 104 on the display of voice quality designating unit 104 shown in FIG. 3, and thereby, makes designating icon 104*i* close to voice quality icon 104A, voice quality 104B and voice quality icon 104Z, voice morphing unit 105 uses voice synthesis parameter value sequence 11 that has been generated by voice synthesis unit 103 on the basis of voice synthesis DB 101*a* of voice quality A, voice synthesis parameter value sequence 11 that has been generated by voice synthesis unit 103 on the basis of voice synthesis DB 101*b* of voice quality B and voice synthesis parameter value sequence 11 that has been generated by voice synthesis unit 103 on the basis of voice synthesis DB 101*z* of voice quality Z so as to carry out a voice morphing process with these having the same ratio. As a result of this, synthetic voice that is outputted from speaker 107 can be made of an intermediate voice quality between voice quality A, voice quality B and voice quality C. In addition, when the user operates voice quality designating unit 104, and thereby, designating icon 104*i* is made close to voice quality icon 104*a*, the voice quality of synthetic voice outputted from speaker 107 can be made close to voice quality A.

In addition, voice quality designating unit 104 of the present embodiment can change the ratio along the time sequence in response to operation by the user, and therefore, the voice quality of synthetic voice outputted from speaker 107 can be smoothly changed along the time sequence. As described in reference to FIG. 4, in the case where, for example, voice quality designating unit 104 changes the ratio so that designating icon 104*i* moves along the track at a rate of 0.01×L per second, such synthetic voice as that of which the voice quality keeps smoothly changing for 100 seconds is outputted from speaker 107.

As a result, a voice synthesis device having a high level of expressiveness; for example "cool at the beginning of speech and gradually getting angry while speaking," which was conventionally impossible, can be implemented. In addition, voice quality of synthetic voice can be continuously changed during one utterance.

Furthermore, in the present embodiment, a voice morphing process is carried out, and therefore, the quality of synthetic voice can be maintained without causing deterioration in the voice quality as in the prior art. In addition, in the present embodiment, intermediate values of characteristic parameters which correspond to each other of sequences of voice synthesis parameter values 11 having different voice quality are calculated, so that a intermediate voice synthesis parameter value sequence 13 is generated, and therefore, the voice quality of synthetic voice can be improved without specifying the portion to be used as a standard by mistake, as compared to a case where a morphing process is carried out on two spectra according to the prior art, and furthermore, the amount of calculation can be reduced. In addition, in the present embodiment, the point at which the state of HMM transits is used, and thereby, a plurality of sequences of voice synthesis parameter values 11 can be precisely matched along the time axis. That is to say, there are cases where the acoustic characteristic differs in the phoneme of voice quality A between the first half and the second half with the point where the state transits as a reference, and the acoustic characteristic differs in the phoneme of voice quality B between the first half and the second half with the point where the state transits as a reference. In such cases, even when the phoneme of voice quality A and the phoneme of voice quality B are respectively and simply expanded and shrunk along the time axis so that the respective times for utterance match, that is to say, the time axis is aligned, the first half and the second half of each of the phonemes which were gained by carrying out a morphing process on the two phonemes are mixed at random. In the case where the point at which the state of HMM transits is used as described above, however, the first half and the second half of each phoneme can be prevented from being mixed at random. As a result of this, the voice quality of phonemes on which morphing processing has been carried out can be improved, and synthetic voice having desired intermediate voice quality can be outputted.

Here, though in the present embodiment, phoneme information 10*a* and a voice synthesis parameter value sequence 11 are generated for each of a plurality of voice synthesis units 103, in the case where all pieces of phoneme information 10*a* which correspond to the voice quality required for the voice morphing process are the same, a process for generating phoneme information 10*a* only in language processing unit 103*a* of one voice synthesis unit 103, and generating a voice synthesis parameter value sequence 11 from this phoneme information 10*a* may be carried out by element connecting units 103*b* of the plurality of voice synthesis units 103.

(Modification)

Here, a modification of a voice synthesis unit of the present embodiment is described.

Figure 7:
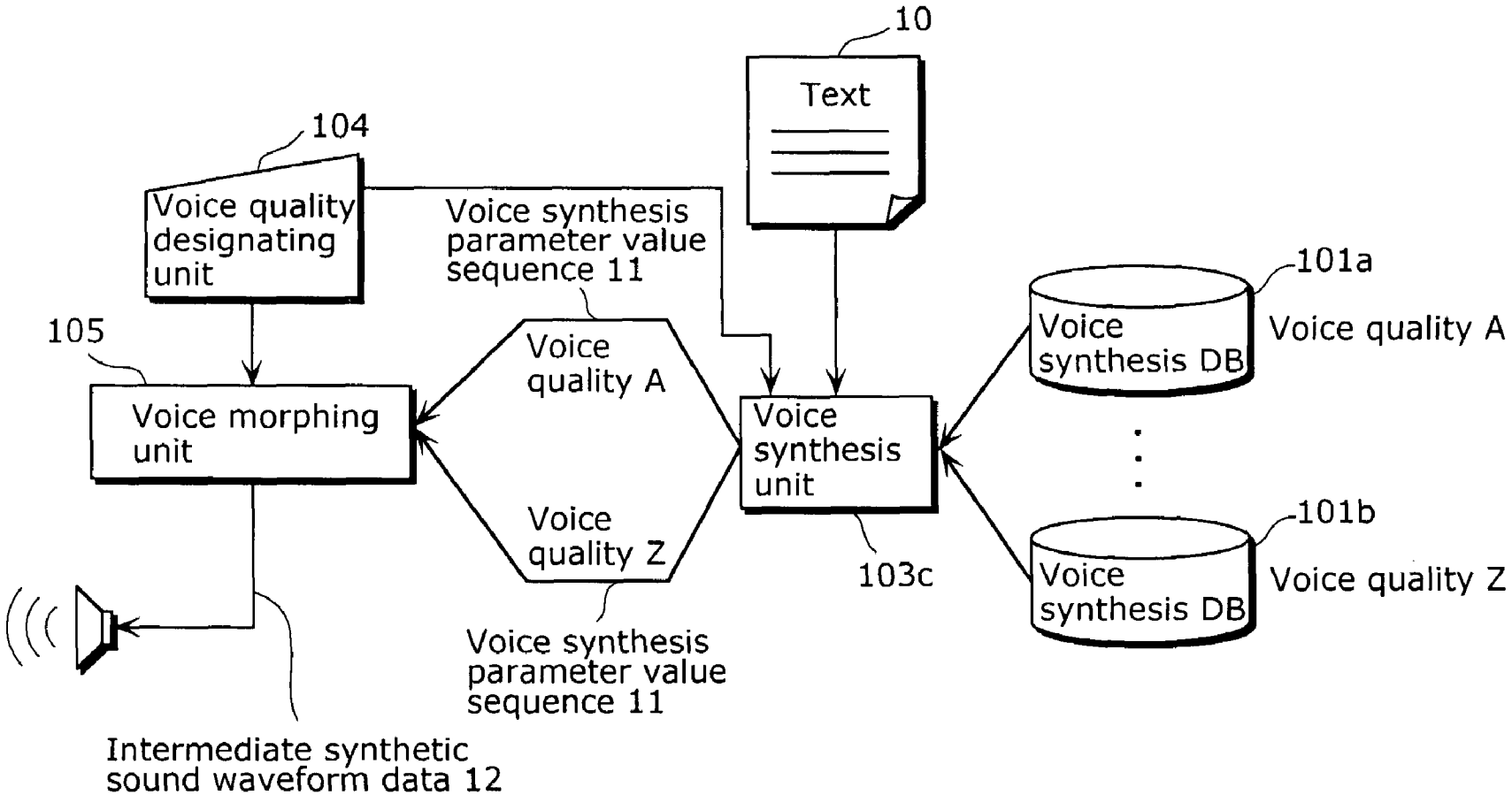
FIG. 7 is a configuration diagram showing the configuration of a voice synthesis device according to a modification of the above described embodiment.

FIG. 7 is a configuration diagram showing the configuration of a voice synthesis device according to the present modification.

The voice synthesis device according to the present modification is provided with one voice synthesis unit 103*c* for generating sequences of voice synthesis parameter values having voice qualities that are different from one another.

This voice synthesis unit 103*c* acquires text 10 and converts a character sequence shown in text 10 to phoneme information 10*a*, and after that, refers to a plurality of voice synthesis DBs 101*a* to 101*z* by switching these sequentially, and thus, sequentially generates sequences of voice synthesis parameter values 11 of a plurality of voice qualities corresponding to this phoneme information 10*a*.

Voice morphing unit 105 stands by until a necessary voice synthesis parameter value sequence 11 are generated, and after that, generates intermediate synthetic sound waveform data 12 in accordance with the same method as that described above.

Here, in the above described case, voice quality designating unit 104 instructs voice synthesis unit 103*c* to generate only the sequences of voice synthesis parameter values 11 that are required by voice morphing unit 105, and thereby, the time for standby of voice morphing unit 105 can be shortened.

As described above, the present modification is provided with only one voice synthesis unit 103*c*, and therefore, miniaturization of the voice synthesis device as a whole and reduction in cost can be achieved.

SECOND EMBODIMENT

Figure 8:
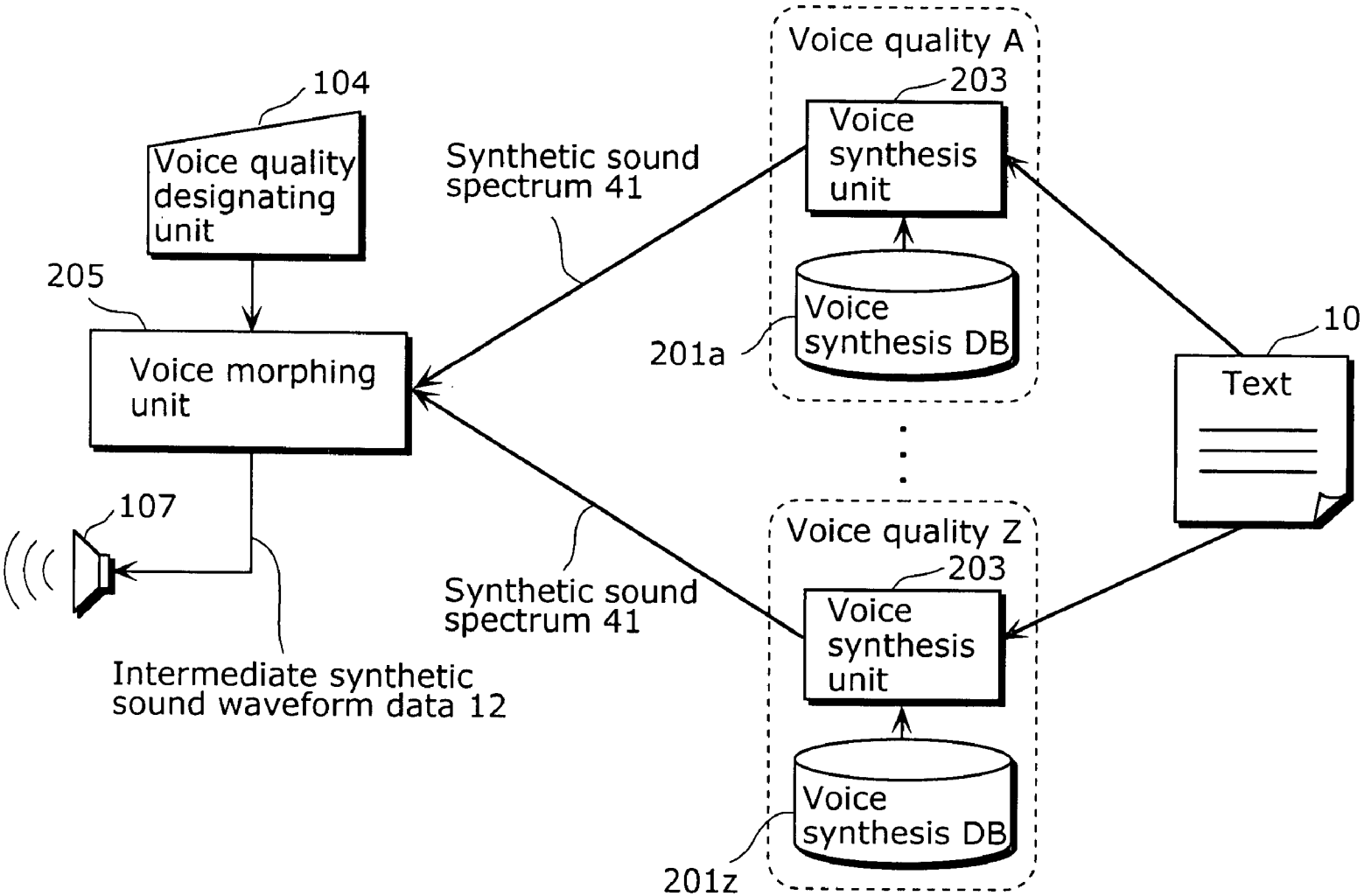
FIG. 8 is a configuration diagram showing the configuration of a voice synthesis device according to the second embodiment of the present invention.

FIG. 8 is a configuration diagram showing the configuration of a voice synthesis device according to the second embodiment of the present invention.

The voice synthesis device of the present embodiment uses a frequency spectrum instead of voice synthesis parameter value sequence 11 in the first embodiment, and carries out a voice morphing process using this frequency spectrum.

This voice synthesis device is provided with: a plurality of voice synthesis DBs 201*a* to 201*z* for storing voice element data on a plurality of voice elements; a plurality of voice synthesis units 203 for generating a synthetic sound spectrum 41 corresponding to a character sequence shown in text 10 using the voice element data that is stored in one voice synthesis DB; a voice quality designating unit 104 for designating voice quality on the basis of operation by the user; a voice morphing unit 205 for carrying out a voice morphing process using synthetic sound spectra 41 that have been generated by the plurality of voice synthesis units 203 and outputting intermediate synthetic sound waveform data 12; and a speaker 107 for outputting synthetic voice on the basis of intermediate synthetic sound waveform data 12.

The voice qualities indicated by the voice element data stored in each of the plurality of voice synthesis DBs 201*a* to 201*z* are different from one another, in the same manner as in voice synthesis DBs 101*a* to 101*z* of the first embodiment. In addition, the voice element data according to the present embodiment is expressed in the form of a frequency spectrum.

The plurality of voice synthesis units 203 are made to correspond one-to-one to each of the above described voice synthesis DBs. In addition, each of voice synthesis units 203 acquires text 10 and converts a character sequence shown in text 10 to phoneme information. Furthermore, voice synthesis units 203 draws out portions on an appropriate voice element from the voice element data of a corresponding voice synthesis DB, and connects and modifies the drawn out portions, and thereby, generates a synthetic sound spectrum 41 which is a frequency spectrum corresponding to the phoneme information that has been generated in advance. This synthetic sound spectrum 41 may be in the form of results of Fourier analysis of voice, or may be in such a form that cepstrum parameter values of voice are aligned in a time sequence.

Voice quality designating unit 104 instructs voice morphing unit 205 which synthetic sound spectrum 41 should be used and with what ratio a voice morphing process should be carried out on this synthetic sound spectrum 41 on the basis of operation by the user, in the same manner as in the first embodiment. Furthermore, voice quality designating unit 104 changes this ratio along the time sequence.

Voice morphing unit 205 according to the present embodiment acquires synthetic sound spectra 41 outputted from the plurality of voice synthesis units 203 and generates a synthetic sound spectrum having intermediate properties between these, and in addition, modifies the synthetic sound spectrum of these intermediate properties to intermediate synthetic sound waveform data 12 and outputs the resulting data.

Figure 9:
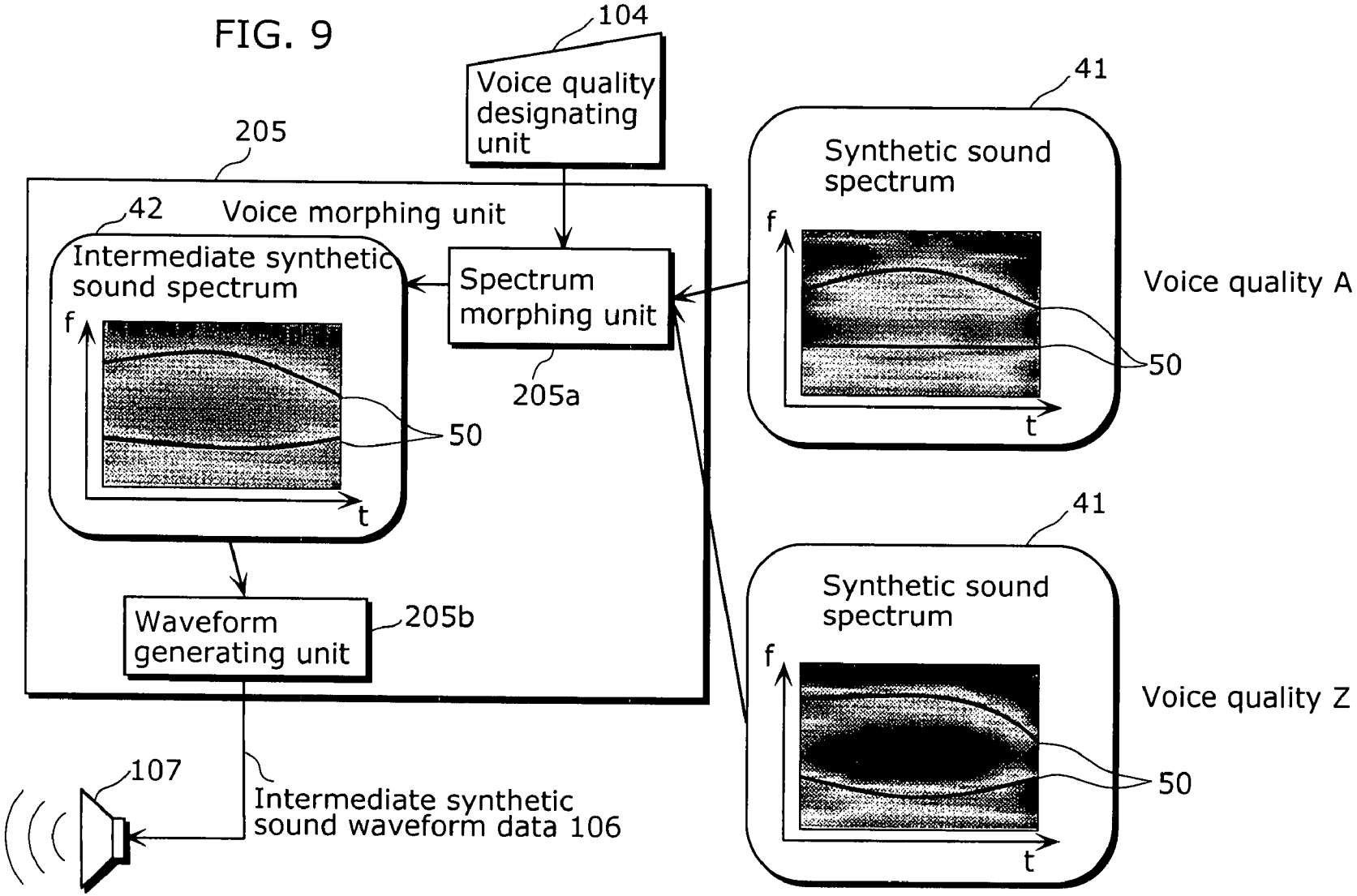
FIG. 9 is an illustrative diagram for illustrating a processing operation of the voice morphing unit of the voice synthesis device.

FIG. 9 is an illustrative diagram for illustrating a processing operation of voice morphing unit 205 according to the present embodiment.

As shown in FIG. 9, voice morphing unit 205 is provided with a spectrum morphing unit 205*a* and a waveform generating unit 205*b*.

Spectrum morphing unit 205*a* specifies at least two synthetics sound spectra 41 that have been designated by voice quality designating unit 104, as well as the ratio, and generates an intermediate synthetic sound spectrum 42 corresponding to this ratio from these synthetic sound spectra 41.

That is to say, spectrum morphing unit 205*a* selects two or more synthetic sound spectra 41 that have been designated by voice quality designating unit 104 from the plurality of synthetic sound spectra 41. Then, spectrum morphing unit 205*a* extracts formant forms 50 which indicate the characteristic of the form of these synthetic sound spectra 41, and modifies each synthetic sound spectrum 41 in such a manner that these formant forms 50 coincide as much as possible, and after that, makes respective synthetic sound spectra 41 overlap. Here, the above described forms of synthetic sound spectra 41 may not be characterized by the formant forms, but may be characterized by, for example, any form which is intensely exhibited to more than a certain degree, and of which the trace can be traced sequentially. As shown in FIG. 9, formant forms 50 schematically show characteristic in the spectrum forms of synthetic sound spectrum 41 of voice quality A and synthetic sound spectrum 41 of voice quality Z, respectively.

Concretely, when spectrum morphing unit 205*a* specifies synthetic sound spectra 41 of voice quality A and voice quality Z, and the ratio of 4:6 on the basis of designation by voice quality designating unit 104, it first acquires a synthetic sound spectrum 41 of voice quality A and a synthetic sound spectrum 41 of voice quality Z, and extracts formant forms 50 from these synthetic sound spectra 41. Next, spectrum morphing unit 205*a* carries out an expanding and shrinking process on synthetic sound spectrum 41 of voice quality A along the frequency axis and the time axis, so that formant form 50 of synthetic sound spectrum 41 of voice quality A becomes closer to formant form 50 of synthetic sound spectrum 41 of voice quality Z by 40%. Furthermore, spectrum morphing unit 205*a* carries out an expanding and shrinking process on synthetic sound spectrum 41 of voice quality Z along the frequency axis and the time axis, so that formant form 50 of synthetic sound spectrum 41 of voice quality Z becomes closer to formant form 50 of synthetic sound spectrum 41 of voice quality A by 60%. Finally, spectrum morphing unit 205*a* makes the power of synthetic sound spectrum 41 of voice quality A on which an expanding and shrinking process has been carried out 60%, and makes the power of synthetic sound spectrum 41 of voice quality Z on which an expanding and shrinking process has been carried out 40%, and after that, makes the two synthetic sound spectra 41 overlap. As a result of this, a voice morphing process is carried out with a ratio of 4:6 on synthetic sound spectrum 41 of voice quality A and synthetic sound spectrum 41 of voice quality Z, so that intermediate synthetic sound spectrum 42 is generated.

Figure 10:
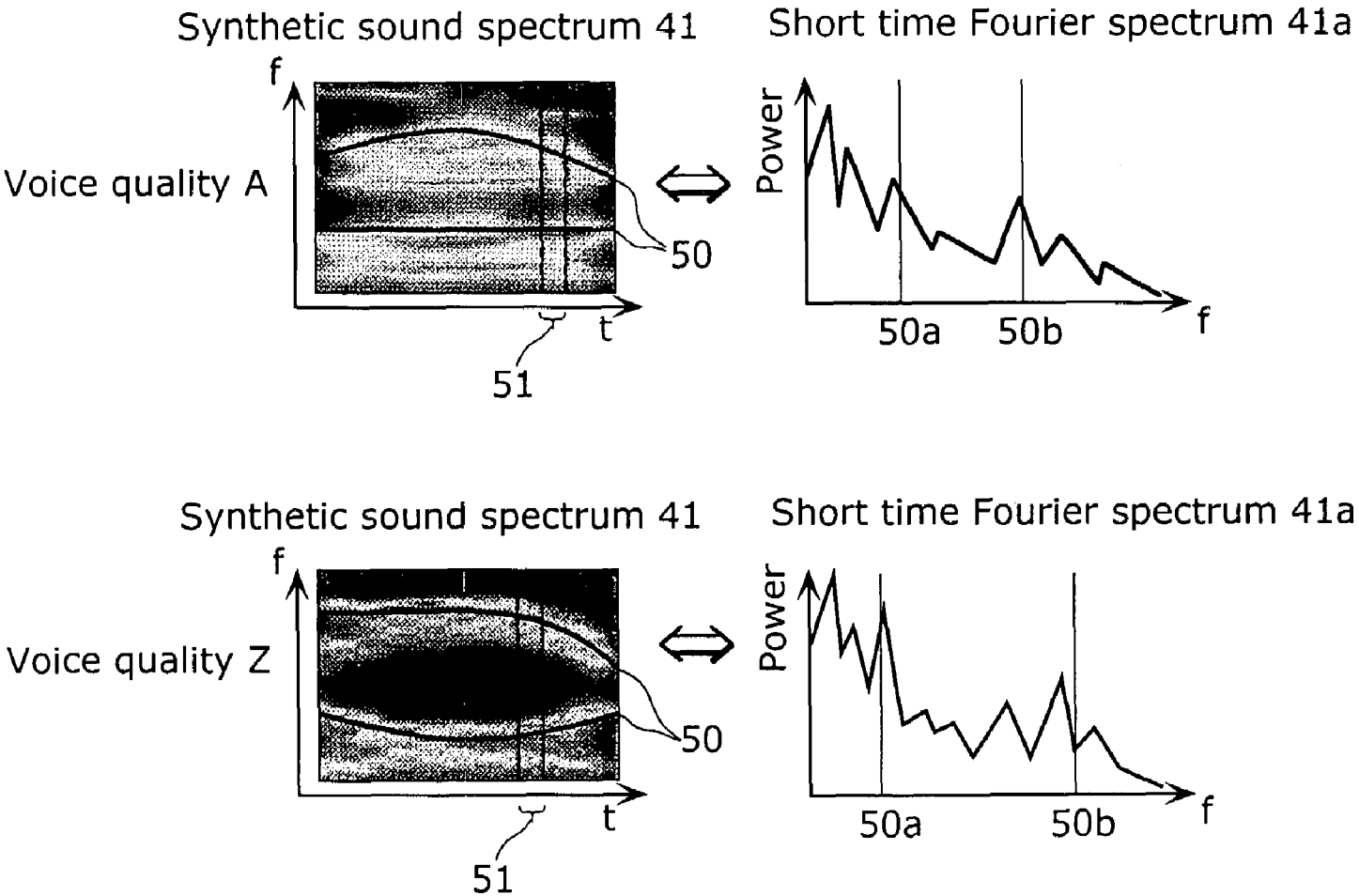
FIG. 10 is a diagram showing spectra of the synthetic sound of voice quality A and voice quality Z of the voice synthesis device, as well as short time Fourier spectra which correspond to these.
Figure 11:
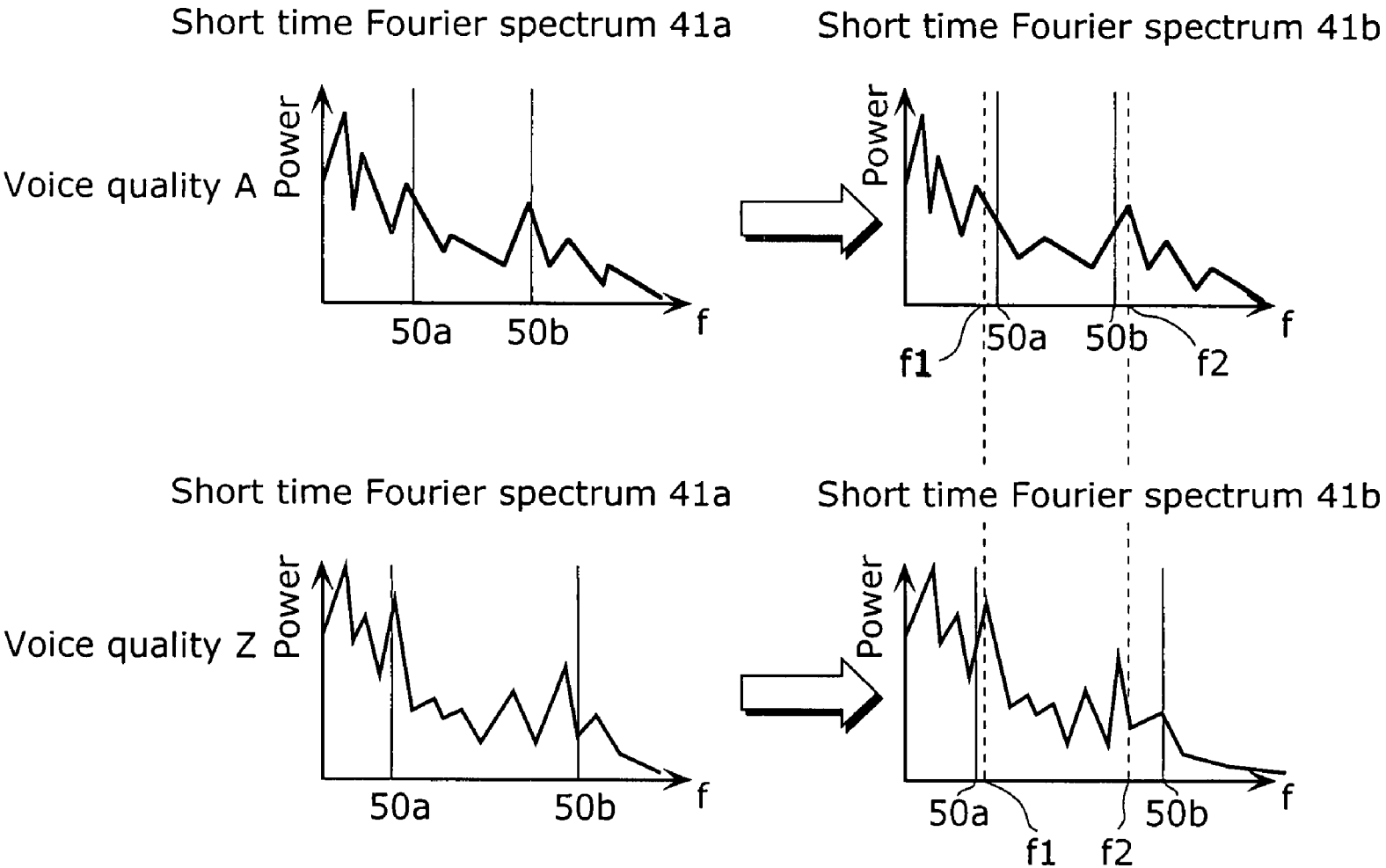
FIG. 11 is an illustrative diagram for illustrating the appearance of the spectrum morphing unit of the voice synthesis device when this voice synthesis device expands and shrinks the two short time Fourier spectra along the axis of frequency.
Figure 12:
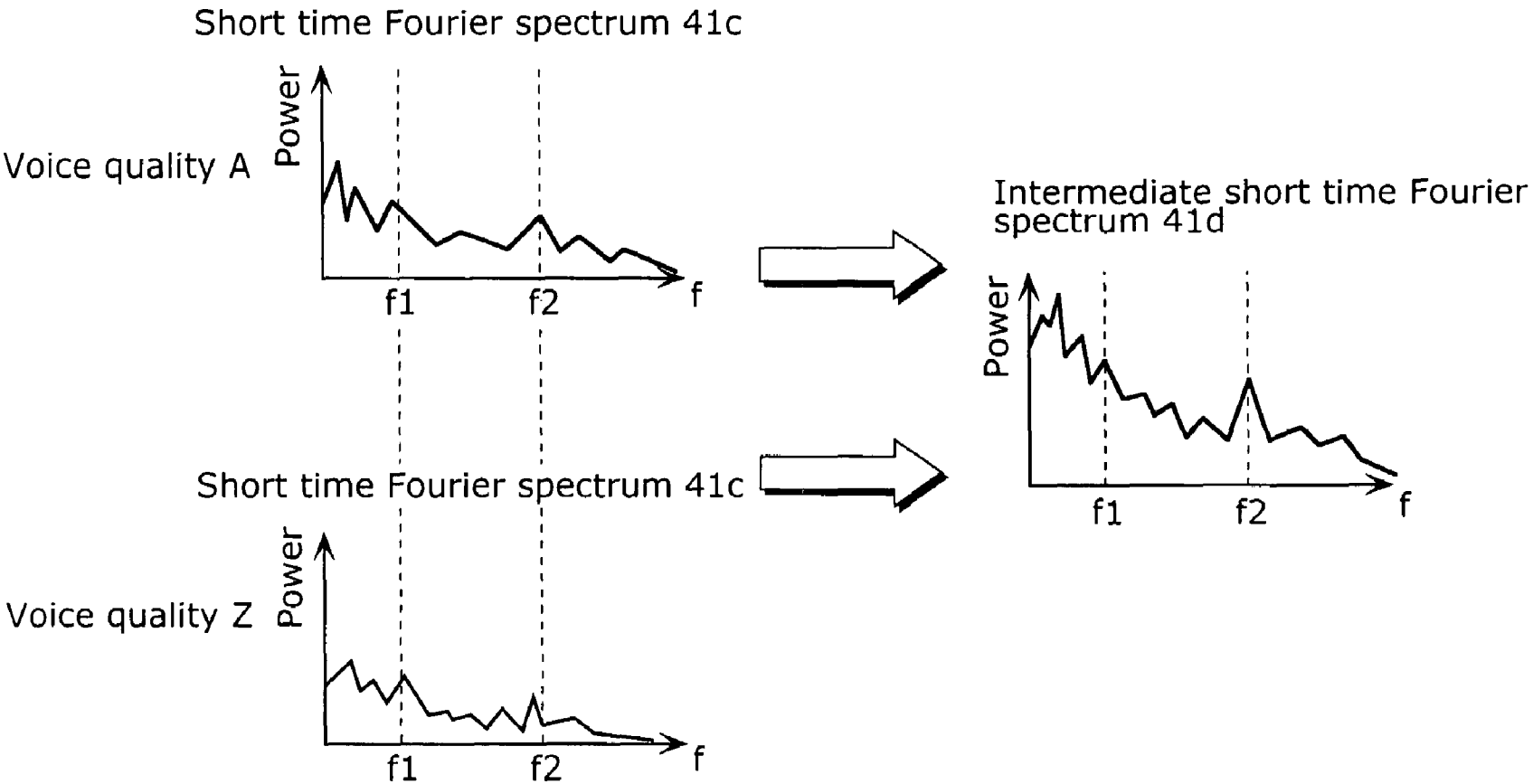
FIG. 12 is an illustrative diagram for illustrating the appearance of the two short time Fourier spectra where the power of the voice synthesis device has been changed, when these two short time Fourier spectra overlap.

A voice morphing process for generating an intermediate synthetic sound spectrum 42 as described above is described in further detail in reference to FIGS. 10 to 12.

FIG. 10 is a diagram showing synthetic sound spectra 41 of sound quality A and sound quality Z, as well as short time Fourier spectra corresponding to these.

When spectrum morphing unit 205*a* carries out a voice morphing process on synthetic sound spectrum 41 of voice quality A and synthetic sound spectrum 41 of voice quality Z with a ratio of 4:6, it first aligns the time axis of respective synthetic sound spectra 41 in order to make formant forms 50 of these synthetic sound spectra 41 closer to each other, as described above. The time axis is aligned in this manner, by matching the patterns of formant forms 50 of respective synthetic sound spectra 41. Here, the patterns may be matched using other characteristic amounts of either synthetic sound spectra 41 or formant forms 50.

That is to say, spectrum morphing unit 205*a* expands or shrinks the two synthetic sound spectra 41 along the time axis in such a manner that the time coincides in the portion of Fourier spectrum analyzed window 51 where the patterns coincide in the respective formant forms 50 of the two synthetic sound spectra 41, as shown in FIG. 10. As a result, the time axis is aligned.

In addition, as shown in FIG. 10, frequencies 50*a* and 50*b* of formant forms 50 are displayed so as to be different from each other in each of short time Fourier spectra 41*a* of Fourier spectrum analyzing window 51 of which the patterns coincide.

Therefore, after the completion of alignment of the time axis, spectrum morphing unit 205*a* carries out an expanding and shrinking process along the frequency axis on the basis of formant forms 50 at each time of the aligned voice. That is to say, spectrum morphing unit 205*a* expands and shrinks the two short time Fourier Spectra 41*a* along the frequency axis, so that frequencies 50*a* and 50*b* coincide in short time Fourier spectra 41*a* of voice quality A and voice quality B at each time.

FIG. 11 is an illustrative diagram for illustrating the appearance of spectrum morphing unit 205*a* when expanding and shrinking the two short time Fourier spectra 41*a* along the frequency axis.

Spectrum morphing unit 205*a* expands or shrinks short time Fourier spectrum 41*a* of voice quality A along the frequency axis in such a manner that frequencies 50*a* and 50*b* in short time Fourier spectrum 41*a* of voice quality A become closer to frequencies 50*a* and 50*b* in short time Fourier spectrum 41*a* of voice quality Z by 40%, and then generates an intermediate short time Fourier spectrum 41*b*. In the same manner as this, spectrum morphing unit 205*a* expands or shrinks short time Fourier spectrum 41*a* of voice quality Z along the frequency axis in such a manner that frequencies 50*a* and 50*b* in short time Fourier spectrum 41*a* of voice quality Z become closer to frequencies 50*a* and 50*b* in short time Fourier spectrum 41*a* of voice quality A by 60%, and then generates an intermediate short time Fourier spectrum 41*b*. As a result of this, a state where the frequency of formant forms 50 are adjusted to frequencies F1 and F2 is gained in the two intermediate short time Fourier spectra 41*b*.

A case where, for example, frequencies 50*a* and 50*b* of formant forms 50 in short time Fourier spectrum 41*a* of voice quality A are 500 Hz and 3000 Hz, frequencies 50*a* and 50*b* of formant forms 50 in short time Fourier spectrum 41*a* of voice quality Z are 400 Hz and 4000 Hz, and the Nyquist frequency of each synthetic sound is 11025 Hz is assumed and described. Spectrum morphing unit 205*a* first expands or shrinks and moves short time Fourier spectrum 41*a* of voice quality A along the frequency axis so that band f of short time Fourier spectrum 41*a* of voice quality A=0 Hz to 500 Hz is converted to 0 Hz to (500+(400−500)×0.4) Hz, band f=500 Hz to 3000 Hz is converted to (500+(400−500)×0.4) Hz to (3000+(4000−3000)×0.4) Hz, and band f=3000 Hz to 11025 Hz is converted to (3000+(4000−3000)×0.4) Hz to 11025 Hz. In the same manner as this, spectrum morphing unit 205*a* expands or shrinks and moves short time Fourier spectrum 41*a* of voice quality Z along the frequency axis so that band f of short time Fourier spectrum 41*a* of voice quality Z=0 Hz to 400 Hz is converted to 0 Hz to (400+(500−400)×0.6) Hz, band f=400 Hz to 4000 Hz is converted to (400+(500−400)×0.6) Hz to (4000+(3000−4000)×0.6) Hz, and band f=4000 Hz to 11025 Hz is converted to (4000+(3000−4000)×0.6) Hz to 11025 Hz. A state where the frequency of formant forms 50 are adjusted to frequency f1 and f2 is gained in the two short time Fourier spectra 41*b* that have been generated as the results of the above described expansion, shrinking and movement.

Next, spectrum morphing unit 205*a* modifies the power of the two short time Fourier spectra 41*b* where the above described modification is carried out along the frequency axis. That is to say, spectrum morphing unit 205*a* converts the power of short time Fourier spectrum 41*b* of voice quality A to 60% of the original power, and converts the power of short time Fourier spectrum 41*b* of voice quality Z to 40% of the original power. Then, spectrum morphing unit 205*a* makes these short time Fourier spectra of which the power has been converted overlap, as described above.

FIG. 12 is an illustrative diagram for illustrating the appearance of the two overlapping short time Fourier spectra of which the power has been converted.

As shown in this FIG. 12, spectrum morphing unit 205*a* makes short time Fourier spectrum 41*c* of voice quality A of which the power has been converted and short time Fourier spectrum 41*c* of voice quality B of which the power has been converted overlap, so that a new short time Fourier spectrum 41*d* is generated. At this time, spectrum morphing unit 205*a* makes the two short time Fourier spectra 41*c* overlap in a state where the above described frequencies f1 and f2 of the respective short time Fourier spectra 41*c* coincide.

Then, spectrum morphing unit 205*a* generates short time Fourier spectrum 41*d* as described above at each time where the time axis of the two synthetic sound spectrum 41 is aligned. As a result of this, a voice morphing process is carried out on synthetic sound spectrum 41 of voice quality A and synthetic sound spectrum 41 of voice quality Z with a ratio of 4:6, so that intermediate synthetic sound spectrum 42 is generated.

Waveform generating unit 205*b* of voice morphing unit 205 converts intermediate synthetic sound spectrum 42 that has been generated by spectrum morphing unit 205*a* as described above to intermediate synthetic sound waveform data 12 and outputs this to speaker 107. As a result of this, synthetic voice which corresponds to intermediate synthetic sound spectrum 42 is outputted from speaker 107.

In this manner, according to the present embodiment, synthetic voice having great freedom in voice quality and good sound quality can be generated from text 10, in the same manner as in the first embodiment.

(Modification example)

Here, a modification example of the operation of the spectrum morphing unit in the present embodiment is described.

The spectrum morphing unit according to the present modification reads out the position of control points in a spline curve that has been stored in a voice synthesis DB in advance without extracting a formant form 50 which shows the characteristic of the form of a synthetic sound spectrum 41 for use as described above, and uses this spline curve instead of formant form 50.

That is to say, formant form 50 which corresponds to each voice element is regarded as a plurality of spline curves on the two-dimensional plane of frequency against time, and the position of the points at which these spline curves are controlled is stored in a voice synthesis DB in advance.

In this manner, the spectrum morphing unit according to the present modification does not extract a formant form 50 from a synthetic sound spectrum 41, but instead carries out a conversion process along the time axis and the frequency axis using a spline curve that is indicated by the position of control points that have been stored in a voice synthesis DB in advance, and therefore, the above described conversion process can be carried out quickly.

Here, formant form 50 may be directly stored in voice synthesis DB 201*a* to 201*z* in advance instead of the position of the control points of the spline curve as described above.

THIRD EMBODIMENT

Figure 13:
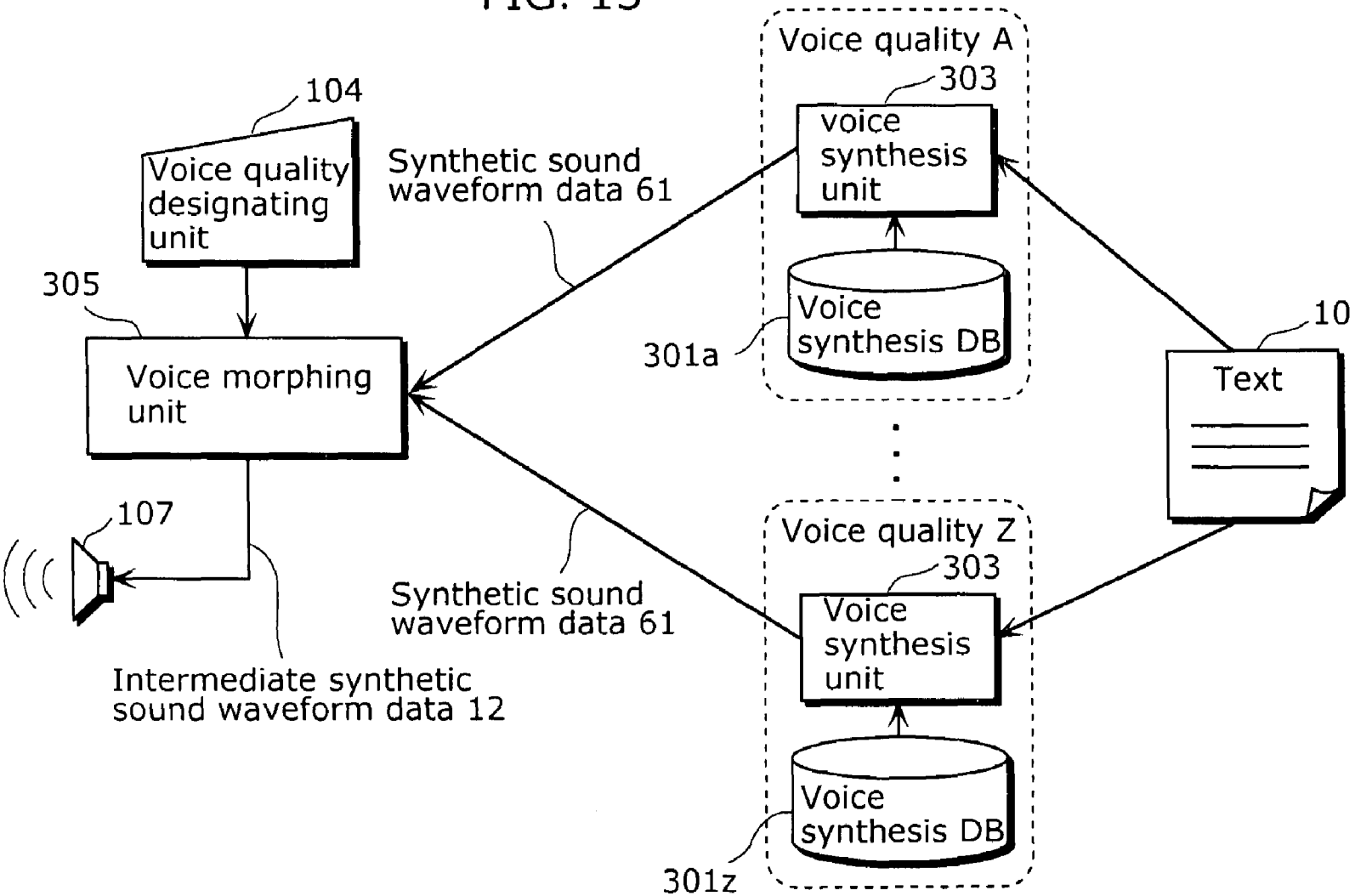
FIG. 13 is a configuration diagram showing the configuration of a voice synthesis device according to the third embodiment of the present invention.

FIG. 13 is a configuration diagram showing the configuration of a voice synthesis device according to the third embodiment of the present invention.

The voice synthesis device of the present embodiment uses a voice waveform instead of voice synthesis parameter value sequence 11 in the first embodiment and synthetic sound spectrum 41 in the second embodiment, and carries out a voice morphing process using this voice waveform.

This voice synthesis device is provided with: a plurality of voice synthesis units 303 for generating synthetic sound waveform data 61 which corresponds to a character sequence shown in text 10 using a plurality of voice synthesis DBs 301*a* to 301*z* for storing voice element data on a plurality of voice elements, as well as voice element data that is stored in one voice synthesis DB; a voice quality designating unit 104 for designating voice quality on the basis of operation by the user; a voice morphing unit 305 which carries out a voice morphing process using synthetic sound waveform data 61 that has been generated by a plurality of voice synthesis units 303, and outputs intermediate synthetic sound waveform data 12; and a speaker 107 for outputting synthetic voice on the basis of intermediate synthetic sound waveform data 12.

Voice quality that is indicated by voice element data is different between that stored in each of the plurality of voice synthesis DBs 301*a* to 301*z*, in the same manner as in voice synthesis DBs 101*a* to 101*z* in the first embodiment. In addition, voice element data according to the present embodiment is expressed in the form of voice waveform.

The plurality of voice synthesis units 303 are made to correspond to each of the above described voice synthesis DBs one-to-one. In addition, each voice synthesis unit 303 acquires text 10 and converts a character sequence in text 10 to phoneme information. Furthermore, voice synthesis units 303 extract portions on an appropriate voice element from the voice element data of the corresponding voice synthesis DB and connect and modify the extracted portions, and thereby, generate synthetic sound waveform data 61, which is voice waveforms corresponding to the phoneme information that has been generated in advance.

Voice quality indicating unit 104 indicates for voice morphing unit 305 which piece of synthetic sound waveform data 61 is used, and with what ratio a voice morphing process is carried out on this synthetic sound waveform data 61 on the basis of operation by the user, in the same manner as in the first embodiment. Furthermore, voice quality indicating unit 104 changes the ratio along the time sequence.

Voice morphing unit 305 according to the present embodiment acquires synthetic sound waveform data 61 outputted from a plurality of voice synthesis units 303, and generates and outputs intermediate synthetic sound waveform data having intermediate properties between these.

Figure 14:
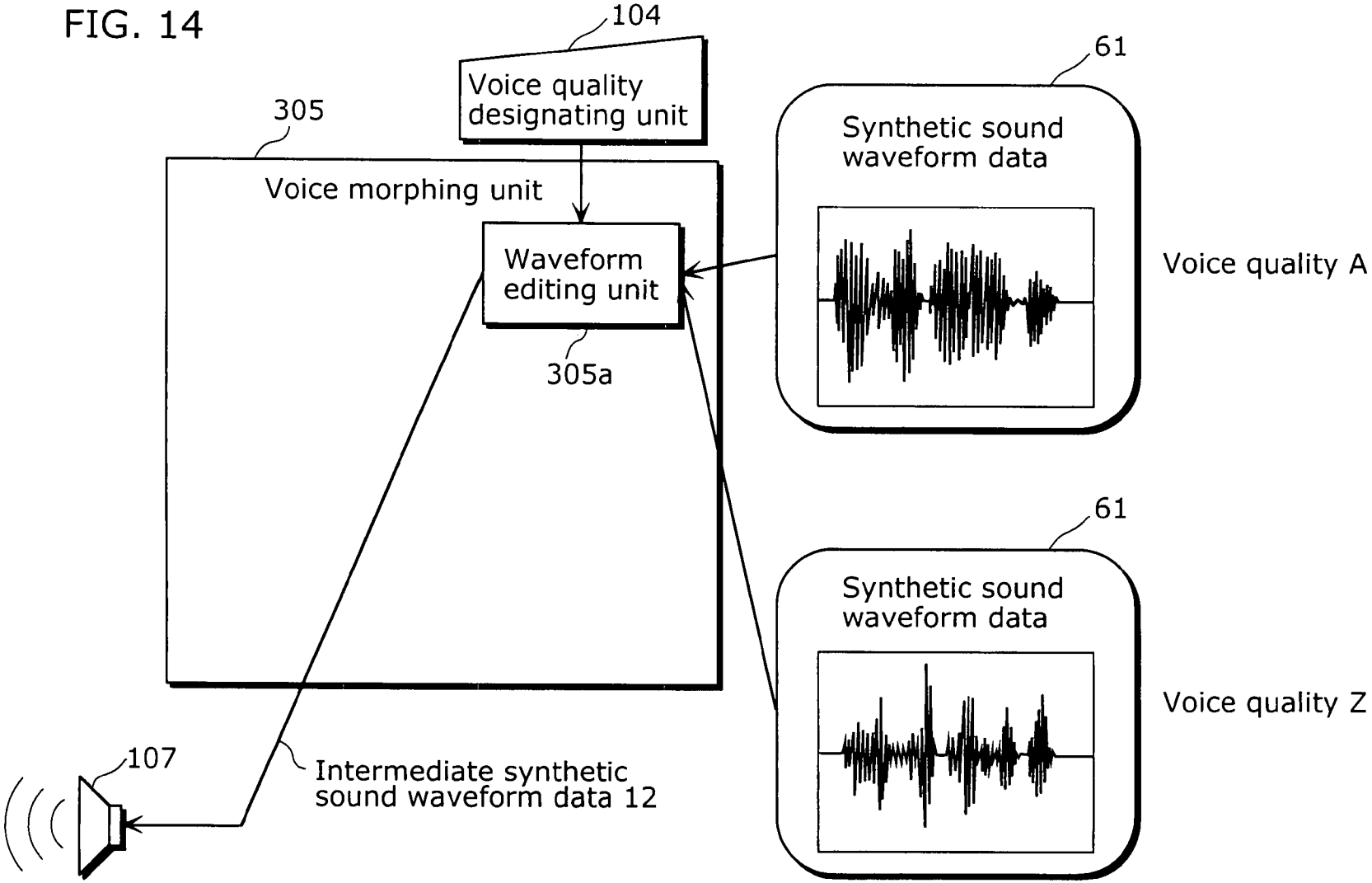
FIG. 14 is an illustrative diagram for illustrating a processing operation of the voice morphing unit of the voice synthesis device.

FIG. 14 is an illustrative diagram for illustrating a processing operation of voice morphing unit 305 according to the present embodiment.

Voice morphing unit 305 according to the present embodiment is provided with a waveform editing unit 305*a*.

This waveform editing unit 305*a* specifies at least two pieces of synthetic sound waveform data 61 that have been designated by voice quality designating unit 104 and the ratio, and generates intermediate synthetic sound waveform data 12 in accordance with this ratio from these pieces of synthetic sound waveform data 61.

That is to say, waveform editing unit 305*a* selects two or more pieces of synthetic sound waveform data 61 that have been designated by voice quality designating unit 104 from among a plurality of pieces of synthetic sound waveform data 61. In addition, waveform editing unit 305*a* modifies, for example, the pitch frequency and the amplitude of each section of voice at each point in time of sampling and the length of continuous time of each voiced section in each section of speech, for each piece of the selected synthetic sound waveform data 61 in accordance with the ratio designated by voice quality designating unit 104. Waveform editing unit 305*a* makes pieces of synthetic sound waveform data 61 that have been formed in this manner overlap, and thereby, generates intermediate synthetic sound waveform data 12.

Speaker 107 acquires thus generated intermediate synthetic sound waveform data 12 from waveform editing unit 305*a* and outputs synthetic voice which corresponds to this intermediate synthetic sound waveform data 12.

In this manner, synthetic voice having great freedom in voice quality and good sound quality can be generated from text 10 in the present embodiment, in the same manner as in the first and second embodiments.

FOURTH EMBODIMENT

Figure 15:
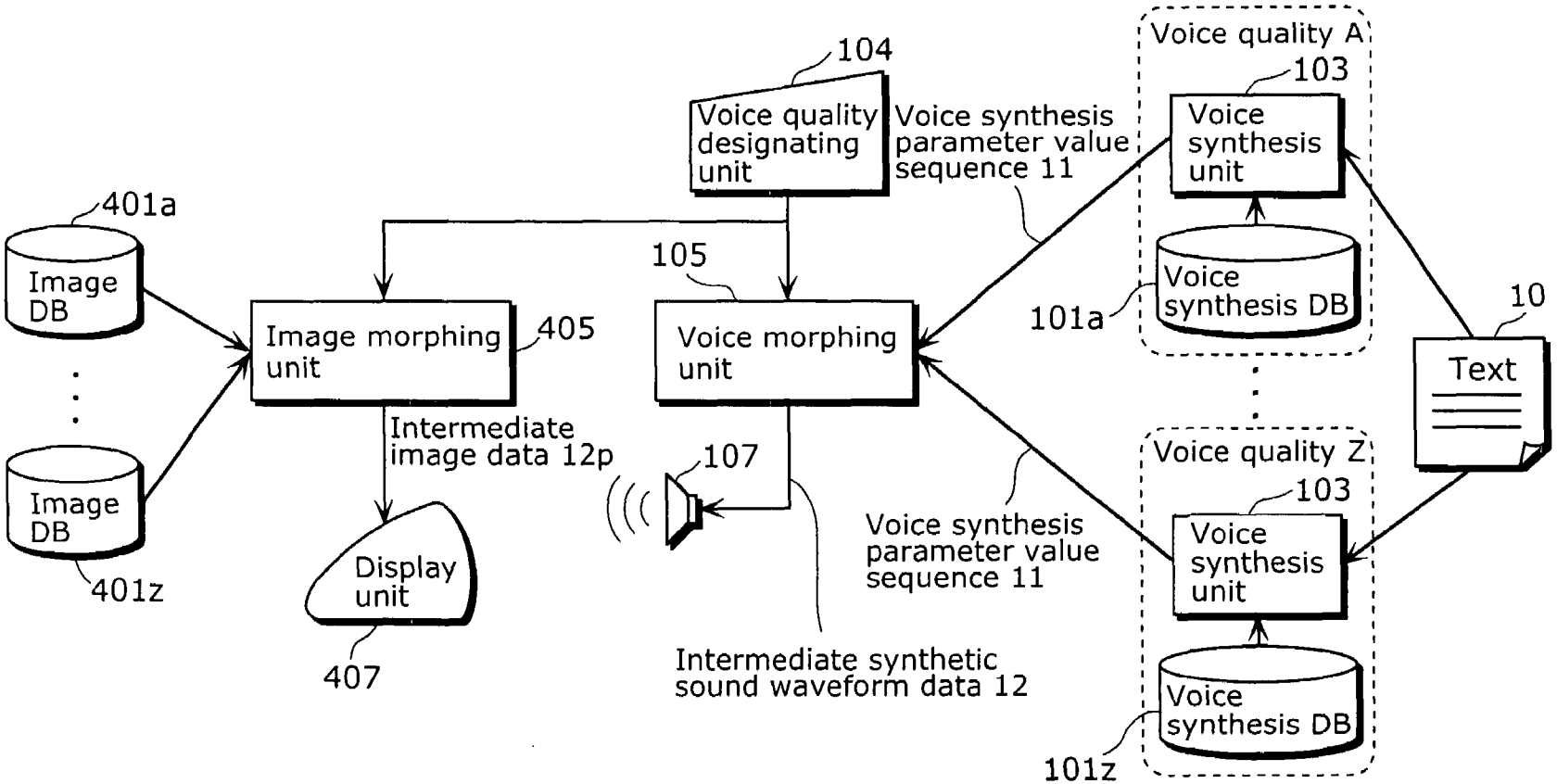
FIG. 15 is a configuration diagram showing the configuration of a voice synthesis device according to the fourth embodiment of the present invention.

FIG. 15 is a configuration diagram showing the configuration of a voice synthesis device according to the fourth embodiment of the present invention.

The voice synthesis device of the present embodiment displays a face image in accordance with the voice quality of the outputted synthetic voice, and is provided with: components that are included in the first embodiment; a plurality of image DBs 401*a* to 401*z* for storing image information on a plurality of face images; an image morphing unit 405 which carries out an image morphing process using information on face images that is stored in these image DBs 401*a* to 401*z* and outputs intermediate face image data 12*p*; and a display unit 407 which acquires intermediate face image data 12*p* from image morphing unit 405 and displays a face image in accordance with this intermediate face image data 12*p*.

Expressions of face images shown by image information that is stored by respective image DBs 401*a* to 401*z* are different from one another. Image information on a face image with an angry expression is stored in, for example, image DB 401*a* which corresponds to voice synthesis DB101*a* having an angry voice quality. In addition, characteristic points, such as eyebrows, the ends and center of the mouth and the center points for the eyes, of a face image that is stored in each of image DBs 401*a* to 401*z* for controlling the impressions of expressions for displaying this face image is added to image information on the face image.

Image morphing unit 405 acquires image information from image DBs that correspond to each voice quality of sequences of synthetic voice parameter values 102 that have been designated by voice quality designating unit 104. Then, image morphing unit 405 carries out an image morphing process in accordance with the ratio designated by voice quality designating unit 104 using the acquired image information.

Concretely, image morphing unit 405 warps the face image of a first acquired piece of image information in such a manner that the position of the characteristic points of the face image that is indicated by this first piece of image information are displaced to the position of the characteristic points of a face image indicated by a second acquired piece of image information with the ratio indicated by voice quality indicating unit 104, and in the same manner, warps the position of this second face image in such a manner that the characteristic points of this second face image are displaced to the position of characteristic points of the first face image with the ratio indicated by voice quality designating unit 104. Then, image morphing unit 405 cross dissolves each of the warped face images in accordance with the ratio that is designated by voice quality designating unit 104, and thereby, generates intermediate face image data 12*p*.

As a result, according to the present embodiment, a face image of an agent, for example, and the impression of the voice quality of the synthetic voice can always be matched. That is to say, the voice synthesis device of the present embodiment carries out voice morphing between the normal voice of an agent and an angry voice, and carries out image morphing between the normal face image of the agent and an angry face image with the same ratio as the voice morphing when synthetic voice having a slightly angry voice quality is generated, so as to display a slightly angry face image that is suitable for this synthetic voice of the agent. In other words, the aural impression the user gets of the agent having emotion and the visual impression can be made to coincide, and thus, the information provided by the agent can be made more natural.

Figure 16:
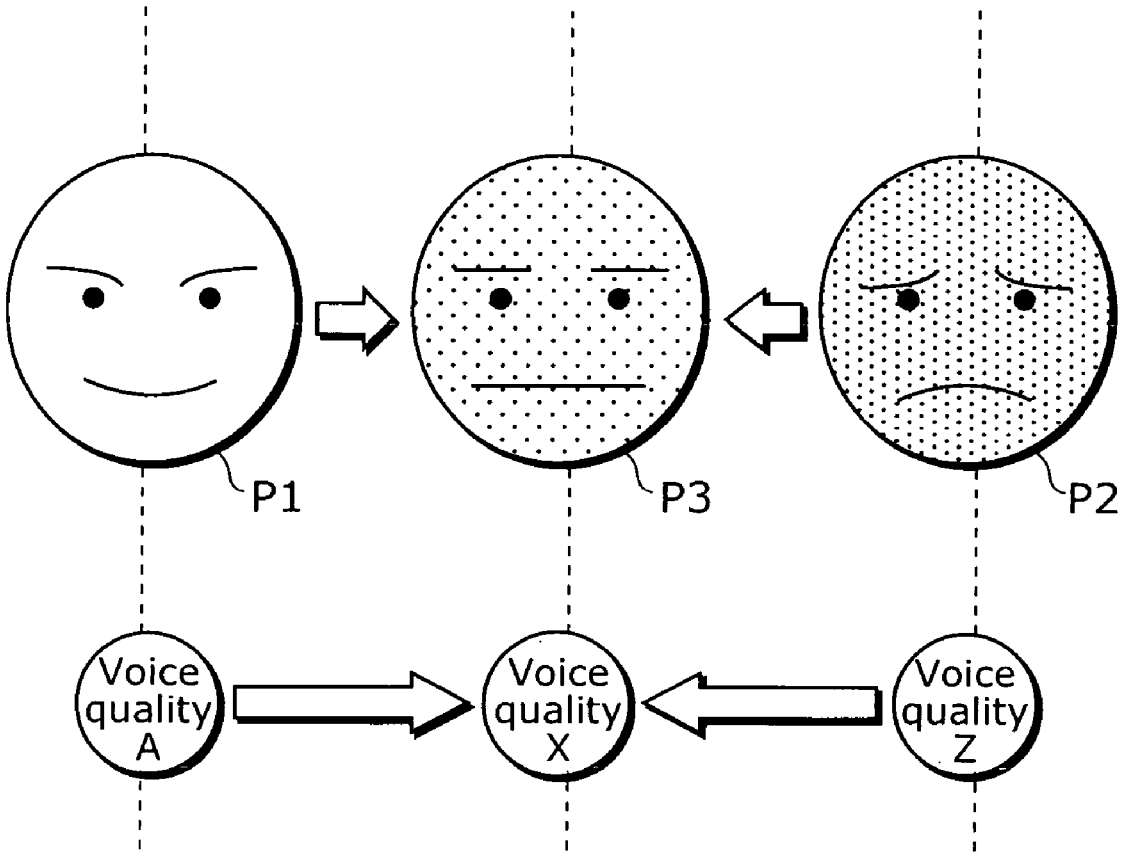
FIG. 16 is an illustrative diagram for illustrating the operation of the voice synthesis device.

FIG. 16 is an illustrative diagram for illustrating the operation of a voice synthesis device according to the present embodiment.

When the user operates a voice quality designating unit 104, for example, and thereby designation icon 104*i* on the display shown in FIG. 3 is placed at a location which divides the line section which connects voice quality icon 104A and voice quality icon 104Z with a ratio of 4:6, the voice synthesis device carries out a voice morphing process in accordance with this ratio of 4:6 using sequences of voice synthesis parameter values 11 of voice quality A and voice quality Z, so that the synthetic voice outputted from speaker 107 becomes closer to voice quality A by 10%, and outputs synthetic voice of intermediate voice quality×between voice quality A and voice quality B. At the same time as this, the voice synthesis device carries out an image morphing process with a ratio of 4:6, which is the same as the above described ratio, using a face image P1 corresponding to voice quality A and a face image P2 corresponding to voice quality Z, and generates and displays an intermediate face image P3 between these images. Here, the voice synthesis device warps face image P1 in such a manner that the position of characteristic points, such as the eyebrows and the ends of the mouth, of this face image P1 change with a ratio of 40% toward the position of characteristic points, such as the eyebrows and the ends of the mouth, of face image P2, as described above when carrying out image morphing, and in the same manner, warps face image P2 in such a manner that the position of characteristic points of this face image P2 changes with a ratio of 60% toward the position of characteristic points of face image P1. In addition, image morphing unit 405 cross dissolves the warped face image P1 with a ratio of 60% and the warped face image P2 with a ratio of 40%, and as a result, generates a face image P3.

In this manner, the voice synthesis device of the present embodiment displays a face image having an "angry" appearance on a display unit 407 when the voice quality of synthetic voice outputted from speaker 107 is "angry" and displays a face image having a "crying" appearance on a display unit 407 when the voice quality is "crying." Furthermore, the voice synthesis device of the present embodiment displays an intermediate face image between the "angry" face image and the "crying" face image when the voice quality is intermediate between the "angry" voice quality and the "crying" voice quality, and changes the intermediate face image chronologically so as to coincide with the voice quality when the voice quality chronologically changes from "angry" to "crying."

Here, image morphing is possible in accordance with various other methods, and any method may be used, as long as a target image can be designated by designating the ratio between the original images.

INDUSTRIAL APPLICABILITY

The present invention has effects such that synthetic voice having great freedom in the voice quality and good sound quality can be generated from text data, and can be applied to a voice synthesis device or the like for outputting synthetic voice conveying emotion to the user.

The invention claimed is:

1. A voice synthesis device, comprising:

a memory unit operable to store, in advance for each voice quality, voice element information regarding a plurality of voice elements having the plural voice qualities that are different from each other;

a voice information generating unit operable to acquire text data, and to generate, from plural pieces of the voice element information stored in said memory unit, synthetic voice information for each of the voice qualities, the synthetic voice information indicating synthetic voice having the voice quality which corresponds to a character that is included in the text data;

a designating unit operable to place fixed points at $N^{th}$ dimensional coordinates for display where N is a natural number, the fixed points indicating voice quality of each piece of the voice element information stored in said memory unit, and to place plural set points at the coordinates for display on the basis of operation by a user so as to derive and designate a ratio at which changes each of plural pieces of the synthetic voice information which contributes to morphing along a time sequence on the basis of the placement of a moving point and the fixed points, the moving point continuously moving between the plural set points along the time sequence;

a morphing unit operable to generate intermediate synthetic voice information using each of the plural pieces of synthetic voice information generated by said voice information generating unit with the ratio of change along the time sequence designated by said designating unit, the intermediate synthetic voice information indicating synthetic voice having intermediate voice quality, between the plural voice qualities, which corresponds to a character that is included in the text data; and a voice outputting unit operable to convert, to synthetic voice having the intermediate voice quality, the intermediate synthetic voice information generated by said morphing unit, and to output the resulting synthetic voice, wherein said voice information generating unit is operable to generate each of the plural pieces of synthetic voice information as a sequence of each of plural characteristic parameters, and said morphing unit is operable to generate the intermediate synthetic voice information by calculating an intermediate value of the plural characteristic parameters to which the plural pieces of synthetic voice information respectively correspond.

2. The voice synthesis device according to claim 1, wherein said morphing unit is operable to change the ratio of contribution of the plural pieces of synthetic voice information to the intermediate synthetic voice information so that the voice quality of the synthetic voice outputted from said voice outputting unit continuously changes during the output of the synthetic voice.

3. The voice synthesis device according to claim 1, wherein said memory unit is operable to store, for each of the plural pieces of voice element information, characteristic information which indicates a standard in each of the voice element that is indicated by each piece of the voice element information in such a manner that the characteristic information is included in each of the plural pieces of voice element information, said voice information generating unit is operable to generate the plural pieces of synthetic voice information in such a manner that the characteristic information is included in each of the plural pieces of synthetic voice information, and said morphing unit is operable to match the plural pieces of synthetic voice information using the standard that is indicated by the characteristic information which is included in each of the plural pieces of synthetic voice information, and to generate the intermediate synthetic voice information.

4. The voice synthesis device according to claim 3, wherein the standard is a point at which an acoustic characteristic of each of the voice element that is indicated by each of the plural pieces of voice element information changes.

5. The voice synthesis device according to claim 4, wherein the point at which the acoustic characteristic changes is a state transition point on the most likely path in which each of the voice element indicated by each of the plural pieces of the voice element information is represented by a hidden Markov model (HMM), and said morphing unit is operable to match the plural pieces of synthetic voice information along the time axis using the state transition point, and to generate the intermediate synthetic voice information.

6. The voice synthesis device according to claim 1, further comprising:

an image storing unit operable to store, in advance for each of the voice quality, image information indicating an image which corresponds to each of the voice quality;

an image morphing unit operable to generate, from a plural pieces of the image information, intermediate image information indicating an image which corresponds to each of the voice quality of the intermediate synthetic sound information; and a display unit operable to acquire the intermediate image information generated by said image morphing unit, and to display the image indicated by the intermediate image information in synchronization with the synthetic voice outputted from said voice outputting unit.

7. The voice synthesis device according to claim 6, wherein the plural pieces of image information respectively indicate face images which correspond to each of the voice quality.

8. A voice synthesis method for generating and outputting synthetic voice using memory which stores, in advance for each voice quality, voice element information regarding a plurality of voice elements having the plural voice qualities that are different from each other, said voice synthesis method comprising:

a text acquiring step of acquiring text data;

a voice information generating step of generating, from plural pieces of the voice element information stored in the memory, synthetic voice information for each of the voice qualities, the synthetic voice information indicating synthetic voice having the voice quality which corresponds to a character that is included in the text data;

a designating step of placing fixed points at $N^{th}$ dimensional coordinates for display where N is a natural number, the fixed points indicating voice quality of each piece of the voice element information stored in the memory, and placing plural set points at the coordinates for display on the basis of operation by a user so as to derive and designate a ratio at which changes each of plural pieces of the synthetic voice information which contributes to morphing along a time sequence on the basis of the placement of a moving point and the fixed points, the moving point continuously moving between the plural set points along the time sequence;

a morphing step of generating intermediate synthetic voice information using each of the plural pieces of synthetic voice information generated by said voice information generating step with the ratio of change along the time sequence designated by said designating step, the intermediate synthetic voice information indicating synthetic voice having intermediate voice quality, between the plural voice qualities, which corresponds to a character that is included in the text data; and a voice outputting step of converting, to synthetic voice having the intermediate voice quality, the intermediate synthetic voice information generated by said morphing step, and outputting the resulting synthetic voice, wherein each of the plural pieces of synthetic voice information is generated as a sequence of each of plural characteristic parameters in said voice information generating step, and the intermediate synthetic voice information is generated by calculating an intermediate value of each of the plural characteristic parameters which corresponds to the plural pieces of synthetic voice information in said morphing step.

9. A program for generating and outputting synthetic voice using memory which stores, in advance for each voice quality, voice element information regarding a plurality of voice elements having the plural voice qualities that are different from each other, said program causing a computer to execute:

a text acquiring step of acquiring text data;

a voice information generating step of generating, from plural pieces of the voice element information stored in the memory, synthetic voice information for each of the voice qualities, the synthetic voice information indicating synthetic voice having the voice quality which corresponds to a character that is included in the text data;

a designating step of placing fixed points at $N^{th}$ dimensional coordinates for display where N is a natural number, the fixed points indicating voice quality of each piece of the voice element information stored in the memory, and placing plural set points at the coordinates for display on the basis of operation by a user so as to derive and designate a ratio at which changes each of plural pieces of the synthetic voice information which contributes to morphing along a time sequence on the basis of the placement of a moving point and the fixed points, the moving point continuously moving between the plural set points along the time sequence;

a morphing step of generating intermediate synthetic voice information using each of the plural pieces of synthetic voice information generated by the voice information generating step with the ratio of change along the time sequence designated by the designating step, the intermediate synthetic voice information indicating synthetic voice having intermediate voice quality, between the plural voice qualities, which corresponds to a character that is included in the text data; and a voice outputting step of converting, to synthetic voice having the intermediate voice quality, the intermediate synthetic voice information generated by the morphing step, and outputting the resulting synthetic voice, wherein each of the plural pieces of synthetic voice information is generated as a sequence of each of plural characteristic parameters in the voice information generating step, and the intermediate synthetic voice information is generated by calculating an intermediate value of each of the plural characteristic parameters which corresponds to the plural pieces of synthetic voice information in the morphing step.

* * * * *